US010639895B2

(12) United States Patent
Takino et al.

(10) Patent No.: US 10,639,895 B2
(45) Date of Patent: May 5, 2020

(54) LIQUID EJECTING HEAD AND LIQUID EJECTING APPARATUS

(71) Applicant: SEIKO EPSON CORPORATION, Tokyo (JP)

(72) Inventors: Fumiya Takino, Shiojiri (JP); Hironori Matsuoka, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/007,801

(22) Filed: Jun. 13, 2018

(65) Prior Publication Data

US 2018/0361741 A1 Dec. 20, 2018

(30) Foreign Application Priority Data

Jun. 15, 2017 (JP) ..... 2017-117477
Feb. 13, 2018 (JP) ..... 2018-022826

(51) Int. Cl.
*B41J 2/14* (2006.01)
*B41J 2/01* (2006.01)

(52) U.S. Cl.
CPC ..... *B41J 2/1433* (2013.01); *B41J 2/14072* (2013.01); *B41J 2/01* (2013.01); *B41J 2002/14491* (2013.01)

(58) Field of Classification Search
CPC ..... B41J 2/1433; B41J 2/14072; B41J 2002/14491; B41J 2/01
See application file for complete search history.

(56) References Cited

U.S. PATENT DOCUMENTS

2005/0001881 A1* 1/2005 Nakashima ..... B41J 2/14233 347/50
2006/0221116 A1 10/2006 Miyata
2007/0211109 A1* 9/2007 Enomoto ..... B41J 2/14233 347/50

(Continued)

FOREIGN PATENT DOCUMENTS

JP 2001-301199 A 10/2001
JP 2001-32229 A 11/2001

(Continued)

OTHER PUBLICATIONS

European Search Report issued in Application No. 18177559 dated Oct. 5, 2018.

*Primary Examiner* — Yaovi M Ameh
(74) *Attorney, Agent, or Firm* — Workman Nydegger

(57) ABSTRACT

A liquid ejecting head includes head units each of which includes a corresponding head substrate and ejects liquid, flexible cables each of which has one end connected to the corresponding head substrate, and a common member including the head units that are fixed thereto. In the liquid ejecting head, when a first direction, a second direction, and a third direction are directions that orthogonally intersect each other and the common member is placed on a virtual surface defined by the first direction and the second direction and has a thickness extending in the third direction, the common member extends more in the first direction than in the second direction. In addition, a fixation region in which each of the flexible cables and the corresponding head substrate are fixed to each other extends more in the second direction than in the first direction when viewed in the third direction.

16 Claims, 12 Drawing Sheets

(56) References Cited

U.S. PATENT DOCUMENTS

| | | | | |
|---|---|---|---|---|
| 2007/0263053 | A1* | 11/2007 | Imai | B41J 2/17503 347/92 |
| 2008/0278539 | A1* | 11/2008 | Han | B41J 2/1404 347/40 |
| 2009/0244240 | A1 | 10/2009 | Sugahara | |
| 2011/0205312 | A1 | 8/2011 | Miyata et al. | |
| 2011/0273497 | A1* | 11/2011 | Yamamoto | B41J 2/14072 347/9 |
| 2011/0310161 | A1 | 12/2011 | Kimura et al. | |
| 2013/0293627 | A1 | 11/2013 | Ishii et al. | |
| 2015/0042726 | A1* | 2/2015 | Enomoto | B41J 2/14201 347/68 |
| 2015/0352855 | A1 | 12/2015 | Nawano et al. | |
| 2016/0089879 | A1* | 3/2016 | Tanaka | B41J 2/04541 347/10 |
| 2016/0096367 | A1* | 4/2016 | Togashi | B41J 2/155 347/40 |
| 2016/0128175 | A1 | 5/2016 | Kobayashi | |
| 2016/0243829 | A1 | 8/2016 | Naito et al. | |
| 2016/0263886 | A1 | 9/2016 | Yasoshima et al. | |
| 2017/0274651 | A1 | 9/2017 | Takino | |

FOREIGN PATENT DOCUMENTS

| | | | |
|---|---|---|---|
| JP | 2001-322293 | A | 11/2001 |
| JP | 2002096468 | A1 | 4/2002 |
| JP | 2006-231678 | A | 9/2006 |
| JP | 2007-30379 | A | 2/2007 |
| JP | 2007-50674 | A | 3/2007 |
| JP | 2009-262544 | A | 11/2009 |
| JP | 2016-92400 | A | 5/2015 |
| JP | 2015-217658 | A | 12/2015 |
| JP | 2015-234722 | A | 12/2015 |
| JP | 2017-177334 | A | 10/2017 |

* cited by examiner

LIQUID EJECTING HEAD AND LIQUID EJECTING APPARATUS

BACKGROUND

1. Technical Field

The present invention relates to a liquid ejecting head equipped with a plurality of head units that eject liquid from nozzles, and to a liquid ejecting apparatus equipped with the liquid ejecting head.

2. Related Art

An example of a liquid ejecting head is an ink jet type recording head that is used in an image recording apparatus, such as an ink jet type recording apparatus. In recent years, a liquid ejecting head that can cause a small amount of liquid to strike precisely at a predetermined position has been advantageously applied to various manufacturing apparatuses. Examples of such apparatuses include a display manufacturing apparatus that manufactures color filters for liquid crystal displays or the like, an electrode forming apparatus that forms electrodes for organic electro luminescence (EL) displays, field emission displays (FED), or the like, and a chip manufacturing apparatus that manufactures biochips. The recording head for the image recording apparatus ejects liquid ink, whereas the coloring material ejecting head for the display manufacturing apparatus ejects solutions of coloring materials including red (R), green (G), and blue (B). The electrode material ejecting head for the electrode forming apparatus ejects liquid electrode materials, and the living organic material ejecting head for the chip manufacturing apparatus ejects bioorganic material solutions.

Among liquid ejecting heads for the above applications, a liquid ejecting head that extends long due to a plurality of head units being arranged in a direction has been proposed. For example, JP-A-2015-231722 discloses a long recording head that extends substantially long in a predetermined direction (for example, in a nozzle row direction). In the long recording head, a plurality of head units are fixed by an adhesive to a base plate, which serves as a supporting plate, and the base plate is fixed to a holder member. One end of a flexible cable is connected to each head unit. The flexible cable supplies drive signals to actuators. The other end of the flexible cable is connected to a circuit substrate disposed in the holder member. An installation portion (i.e., fixation region) between the flexible cable and the head unit and an installation portion between the flexible cable and the circuit substrate are oriented in the longitudinal direction of the liquid ejecting head. In other words, a plurality of terminals in the installation portion are arranged side by side in the longitudinal direction of the liquid ejecting head. The liquid ejecting head formed as such may be subject to warping due to, for example, differences between the coefficients of thermal expansion of components. Warping tends to increase particularly in the longitudinal direction. In the case where an installation portion of the flexible cable, which is constituted by electric contacts, extends in the longitudinal direction of the liquid ejecting head, warping of the components in the longitudinal direction may cause detachment of the flexible cable at the installation portion, which poses a problem. To address this problem, the liquid ejecting head according to JP-A-2015-231722 uses a plurality of metallic correction plates as a measure against warping. The liquid ejecting head is thereby suppressed from warping.

However, the above configuration of using correction plates to suppress the liquid ejecting head from warping has a problem in that the number of parts increases and provision of the correction plates poses restrictions on the components in terms of their dimensions, shape, or the like.

SUMMARY

An advantage of some aspects of the invention is that a liquid ejecting head and a liquid ejecting apparatus that can suppress detachment of a flexible cable at an installation portion due to warping of the components are provided.

A liquid ejecting head according to an aspect of the invention includes head units each of which includes a corresponding head substrate and ejects liquid, flexible cables each of which has one end connected to the corresponding head substrate, and a common member including the head units that are fixed thereto. In the liquid ejecting head, when a first direction, a second direction, and a third direction are directions that orthogonally intersect each other and the common member is placed on a virtual surface defined by the first direction and the second direction and has a thickness extending in the third direction, the common member extends more in the first direction than in the second direction. In addition, a fixation region in which each of the flexible cables and the corresponding head substrate are fixed to each other extends more in the second direction than in the first direction when viewed in the third direction.

According to this aspect of the invention, the fixation region in which each of the flexible cables and the corresponding head substrate are fixed to each other, in other words, an installation portion of the corresponding head substrate to which each flexible cable is installed, extends more in the second direction than in the first direction. Accordingly, even if the common member or a component that extends more in the first direction warps in the first direction, detachment does not readily occur in the fixation region. This can reduce the likelihood of a failure such as a loose connection occurring at the installation portion without separately providing a member for suppressing warping, such as a correction plate.

A liquid ejecting head according to another aspect of the invention includes head units each of which includes a corresponding head substrate and ejects liquid, flexible cables each of which has one end connected to the corresponding head substrate and supplies a drive signal to a corresponding one of the head units, a common member including the head units that are fixed thereto. In the liquid ejecting head, when a first direction, a second direction, and a third direction are directions that orthogonally intersect each other and the common member is placed on a virtual surface defined by the first direction and the second direction and has a thickness extending in the third direction, the common member extends more in the first direction than in the second direction. In addition, each of the flexible cables includes a first portion extending along the corresponding head substrate, a second portion extending in a direction intersecting the corresponding head substrate, and a curved portion located between the first portion and the second portion, and the curved portion extends more in the second direction than in the first direction when viewed in the third direction.

According to this aspect of the invention, each flexible cable includes the curved portion located between the first portion extending along the corresponding head substrate and the second portion extending in a direction intersecting the head substrate, and the curved portion extends more in the second direction than in the first direction that is the longitudinal direction of the common member. As a result, even when the common member and other components that extend in the first direction warp, detachment of the flexible cable from the head substrate does not readily occur in the fixation region, in other words, in an installation portion at which the flexible cable is installed to the corresponding head substrate. This can reduce the likelihood of a failure such as a loose connection occurring at the installation portion without separately providing a member for suppressing warping, such as a correction plate.

It is desirable that liquid ejecting head further include a circuit substrate to which another end of each of the flexible cables is fixed, and that in the liquid ejecting head, a region in which each of the flexible cables and the circuit substrate are fixed to each other extends more in the second direction than in the first direction when viewed in the third direction.

According to this configuration, the region in which each flexible cable and the circuit substrate are fixed to each other, in other words, the installation portion of the circuit board to which the flexible cable is installed, extends more in the second direction than in the first direction. As a result, even when the common member and other components that extend more in the first direction warp in the first direction, detachment of the flexible cable at the installation portion does not readily occur.

It is desirable that the liquid ejecting head further include a circuit substrate to which another end of each of the flexible cables is fixed. In the liquid ejecting head, it is also desirable that each of the flexible cables include a first portion extending along the circuit substrate, a second portion extending in a direction intersecting the circuit substrate, and a curved portion located between the first portion and the second portion, and that the curved portion extend more in the second direction than in the first direction.

According to this configuration, each flexible cable includes the curved portion located between the first portion extending along the circuit substrate and the second portion extending in a direction intersecting the circuit substrate, and the curved portion extends more in the second direction than in the first direction. As a result, when the common member and other components that extend in the first direction warp in the first direction, detachment of the flexible cable from the circuit substrate at the installation portion does not readily occur.

A liquid ejecting head according to still another aspect of the invention includes head units each of which includes a corresponding head substrate and ejects liquid, flexible cables each of which has one end connected to the corresponding head substrate and supplies a drive signal to a corresponding one of the head units, a common member including the head units that are fixed thereto, and a circuit substrate to which another end of each of the flexible cables is fixed. In the liquid ejecting head, when a first direction, a second direction, and a third direction are directions that orthogonally intersect each other and the common member is placed on a virtual surface defined by the first direction and the second direction and has a thickness extending in the third direction, the common member extends more in the first direction than in the second direction. In addition, a region in which each of the flexible cables and the circuit substrate are fixed to each other extends more in the second direction than in the first direction when viewed in the third direction.

According to this aspect of the invention, the region in which each flexible cable and the circuit substrate are fixed to each other, in other words, the installation portion of the circuit substrate to which each flexible cable is installed, extends more in the second direction than in the first direction. As a result, even when the common member and other components that extend more in the first direction warp in the first direction, detachment of the flexible cable at the installation portion does not readily occur.

A liquid ejecting head according to still another aspect of the invention includes head units each of which includes a corresponding head substrate and ejects liquid, flexible cables each of which has one end connected to the corresponding head substrate and supplies a drive signal to a corresponding one of the head units, a common member including the head units that are fixed thereto, and a circuit substrate to which another end of each of the flexible cables is fixed. In the liquid ejecting head, when a first direction, a second direction, and a third direction are directions that orthogonally intersect each other and the common member is placed on a virtual surface defined by the first direction and the second direction and has a thickness extending in the third direction, the common member extends more in the first direction than in the second direction. In addition, each of the flexible cables includes a first portion extending along the circuit substrate, a second portion extending in a direction intersecting the circuit substrate, and a curved portion located between the first portion and the second portion, and the curved portion extends more in the second direction than in the first direction when viewed in the third direction.

According to this aspect of the invention, each flexible cable includes the curved portion located between the first portion extending along the circuit substrate and the second portion extending in a direction intersecting the circuit substrate, and the curved portion extends more in the second direction than in the first direction. As a result, when the common member, the circuit substrate, and other components that extend in the first direction warp in the first direction, detachment of the flexible cable from the circuit substrate does not readily occur at the installation portion.

It is desirable that the liquid ejecting head further include a plurality of the circuit substrates and a cover member that extends more in the first direction than in the second direction and covers the plurality of the circuit substrates in collaboration with the common member.

According to this configuration, a plurality of the circuit substrates are provided. The size of each circuit substrate can be thereby reduced compared with the case where a single circuit substrate is provided. This can reduce warping of each individual circuit substrate. As a result, detachment of the flexible cable from the circuit substrate does not readily occur at the installation portion. In addition, the circuit substrates are sandwiched by the cover member and the common member, thereby protecting the circuit substrates.

It is desirable that in the liquid ejecting head, each of the flexible cables be loose between the corresponding head substrate and the circuit substrate.

According to this configuration, each flexible cable is loose between the head substrate and the circuit substrate. As a result, even when the common member and the components that extend more in the first direction warp, the loose portion provides an extra margin in the length of the flexible cable and the extra margin can relieve an impact of warping. As a result, detachment of the flexible cable can be suppressed reliably at the installation portion.

It is desirable that in the liquid ejecting head, each of the flexible cables be folded between the corresponding head substrate and the circuit substrate.

According to this configuration, each flexible cable is folded between the head substrate and the circuit substrate. As a result, even when the common member and the components that extend more in the first direction warp, the folded portion provides an extra margin in the length of the flexible cable and the extra margin can relieve an impact of warping. As a result, detachment of the flexible cable can be suppressed reliably at the installation region.

It is desirable that the liquid ejecting head further include a holder member that extends more in the first direction than in the second direction when viewed in the third direction, and that in the liquid ejecting head, the holder member include a first recess that is formed on a first side of the holder member and in which the head units are accommodated and a second recess that is formed on a second side of the holder member, the second side being opposite to the first side, and in which the circuit substrate is accommodated.

According to this configuration, the first side and the second side of the holder member have recesses, respectively, and the strengths of structures partitioning the recesses in the first side and in the second side can be made similar. As a result, the holder member is not easily subject to deformation, such as warping or twisting.

In the liquid ejecting head, a coefficient of thermal expansion of the holder member can be different from a coefficient of thermal expansion of the common member.

According to this configuration, the difference in the coefficient of thermal expansion tends to cause the holder member and the common member to warp. Even in this case, detachment of the flexible cable can be suppressed at the installation portion. This improves flexibility in the selection of materials for the holder member and the common member without being restricted by the difference in the coefficient of thermal expansion. A material that warps largely can be predicted in advance. Thus, it is easier to address warping by changing the longitudinal direction of the installation portion of the flexible cable that is disposed on the component so as to orient the installation portion in the second direction.

It is desirable that in the liquid ejecting head, each of the head units extend more in the first direction than in the second direction, and the head units be arranged in the first direction.

According to this configuration, the liquid ejecting head can be made to extend in the first direction.

It is desirable that in the liquid ejecting head, when viewed in the third direction, a region in which each of the flexible cables and the corresponding head substrate are fixed to each other overlap a region in which a corresponding one of the head units and the common member are fixed to each other.

According to this configuration, the size of the head substrate can be reduced and the head units can be thereby arranged densely compared with the case where the region in which each flexible cable and the corresponding head substrate are fixed to each other does not overlap the region in which the head unit and the common member are fixed to each other. Moreover, this can increase the area of the fixation region and thereby enables reliable fixation of the head units to the common member.

It is desirable that in the liquid ejecting head, a position at which each of the flexible cables starts to extend away from the corresponding head substrate be located away from a center of a corresponding one of the head units in the first direction, and that each of the flexible cables fixed to the corresponding head substrate of each of the head units that are located closer to respective ends of the common member in the first direction than the rest of the head units be disposed away from a center of the common member in the first direction.

The flexible cables tend to generate heat. According to this configuration, the flexible cables fixed to the corresponding head substrates of the head units that are located closer to respective ends of the common member in the first direction than the rest of the head units are disposed away from the center of the common member in the first direction. By disposing the flexible cables this way, the temperature gradient within the liquid ejecting head can be reduced. As a result, variation in characteristics of each head unit due to temperature fluctuation can be suppressed.

It is desirable that in the liquid ejecting head, each of the flexible cables include conductors, and that a thickness of each of the conductors at the one end be less than a thickness of each of the conductors at another end of each of the flexible cables.

According to this configuration, the thickness of the conductors at the one end of each flexible cable is less than that at the other end thereof. As a result, the length of the fixation region of the corresponding head substrate in the second direction can be reduced. Thus, the size of each head unit in the second direction can be reduced. The thickness of the conductors at the other end of each flexible cable is larger than that of the conductors at the one end, thereby reducing the resistance of the conductors.

It is desirable that in the liquid ejecting head, each of the flexible cables include conductors, and that a pitch between the conductors at the one end be narrower than a pitch between the conductors at another end of each of the flexible cables.

According to this configuration, the pitch between the conductors at the one end of the flexible cable is narrower than that at the other end. As a result, the length of the fixation region of the head substrate can be reduced in the second direction. Thus, the size of each head unit in the second direction can be reduced. On the other hand, the larger pitch of the conductors near the other end, compared with the pitch near the one end, can facilitate the connection work of the other end.

It is desirable that in the liquid ejecting head, each of the flexible cables include conductors and the conductors be arranged, at the one end, in a width direction of each of the flexible cables, and that the conductors be arranged, at another end, in a longitudinal direction of each of the flexible cables.

According to this configuration, the conductors at the one end of the flexible cable are arranged in the width direction of the flexible cable, which can reduce, in the second direction, the length of the fixation region at which the one end of the flexible cable is fixed to the head substrate. Thus, the size of each head unit in the second direction can be reduced. In addition, the conductors are arranged in the longitudinal direction at the other end of the flexible cable, which increases freedom in wiring layout at the other end. In other words, the pitch and thickness of the conductors can be set flexibly at the second end.

A liquid ejecting apparatus according to still another aspect of the invention includes the liquid ejecting head as described above.

According to this aspect of the invention, detachment of the flexible cable at the installation portion due to warping of the common member and the components that extend more in the first direction can be suppressed, which improves the reliability of the liquid ejecting apparatus.

BRIEF DESCRIPTION OF THE DRAWINGS

The invention will be described with reference to the accompanying drawings, wherein like numbers reference like elements.

FIG. 14 is a cross-sectional view illustrating the liquid ejecting head according to the second embodiment, which is cut in the Y direction and.

DESCRIPTION OF EXEMPLARY EMBODIMENTS

Exemplary embodiments will be described with reference to the accompanying drawings. Note that although various limitations will be included in the description of exemplary embodiments in order to describe preferred examples of the invention, such particular configurations should not be construed as limiting the scope of the invention unless expressly stated otherwise. Also note that the following description is based, by way of example, on an ink jet type printer (hereinafter referred to as "printer 1") in which an ink jet type recording head (hereinafter simply referred to as "recording head 3"), which is a type of liquid ejecting head, is mounted. The ink jet type printer serves as a liquid ejecting apparatus according to the invention.

Figure 1:
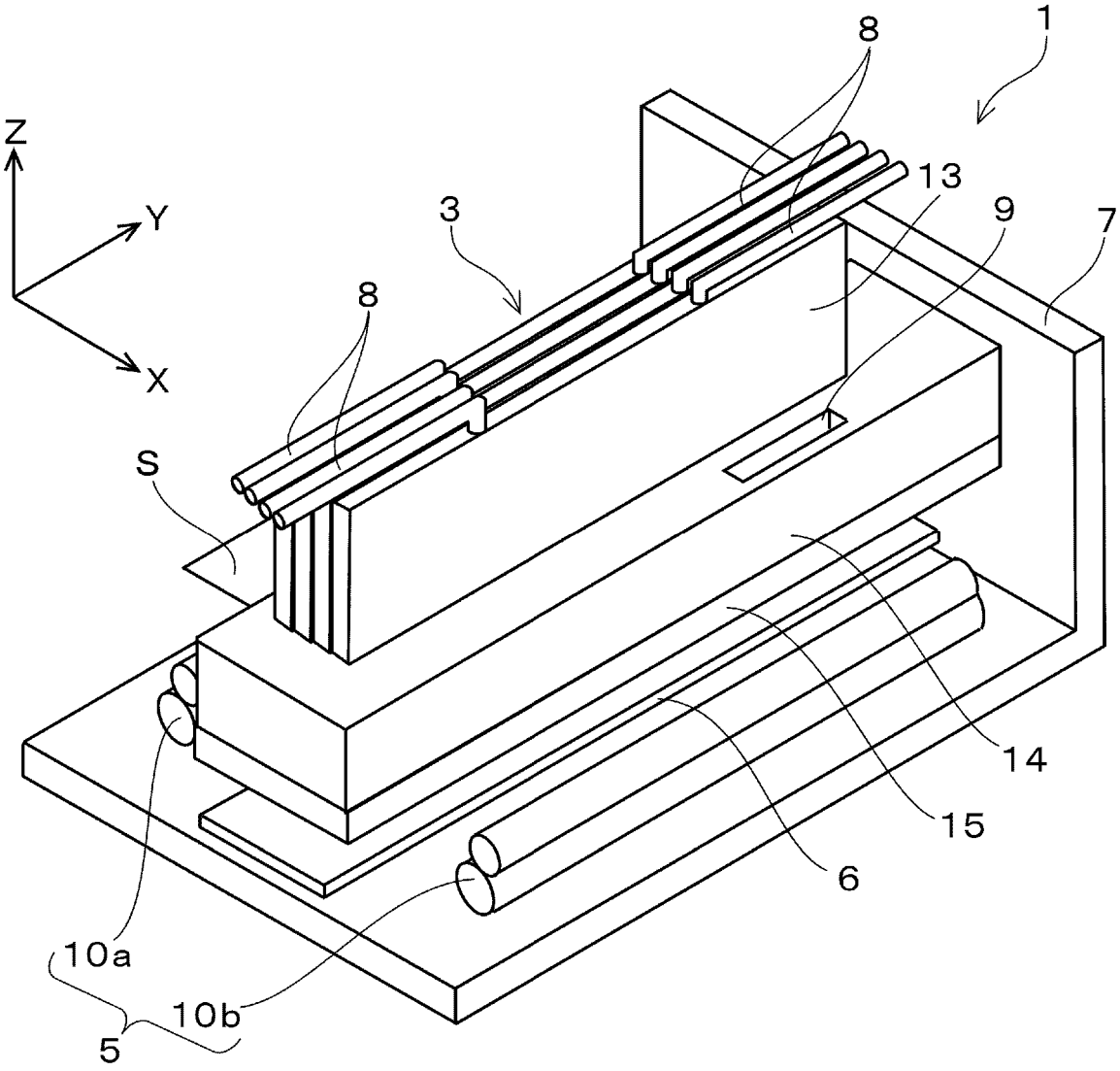
FIG. 1 is a perspective view illustrating a structure of an example of a liquid ejecting apparatus.

A structure of the printer 1 will be described with reference to FIG. 1. Note that in the drawings, the X direction (which corresponds to a second direction according to the invention), the Y direction (which corresponds to a first direction according to the invention), and the Z direction (which corresponds to a third direction according to the invention) are directions that intersect each other orthogonally. The printer 1 is an apparatus that records images or the like by ejecting liquid ink onto a surface of a recording medium S, such as a sheet of paper for recording. The printer 1 includes, inside an apparatus body 7, mainly a recording head 3 that has a plurality of head units 4, a transport mechanism 5 that transports a recording medium S, and a medium support platform 6 (otherwise called a "platen") that supports a recording medium S transported to a position that opposes nozzle faces of the head units 4 (see FIG. 2).

The X direction corresponds to the transport direction of a recording medium S. The recording head 3 according to the embodiment is a line head that is formed to be longer in the Y direction, which orthogonally intersects the X direction, than in the X direction. When the recording head 3 is placed on a virtual surface defined by the X direction and the Y direction, the Z direction represents a thickness direction of the recording head 3 and of components constituting the recording head 3 (i.e., a direction of stacking the components). Of the dimensions in the X direction, in the Y direction, and in the Z direction of each component, in particular, of a common member such as a holder member 15 or a base plate 17 which will be described later, the length in the Z direction is the smallest. Liquid supply tubes 8 are connected to the recording head 3. Each liquid supply tube 8 is in communication with the inside of an ink cartridge (not illustrated) that stores ink, which is a type of liquid. Ink supplied from an ink cartridge is subsequently supplied to a flow path member 13, which will be described later, via one of the liquid supply tubes 8. Note that ink cartridges may be mounted on top of the recording head 3. The recording head 3 includes circuit substrates 16 each of which has a connector 36, which will be described later. An external connection cable (not illustrated) is inserted through a cable insertion opening 9 and connected to the connector 36. The external connection cable, which may be a flat flexible cable (FFC), supplies drive signals or the like from a control unit to the recording head 3.

The transport mechanism 5 includes a pair of first transport rollers 10*a* having an upper roller and a lower roller at a position upstream of the medium support platform 6 in the X direction. The transport mechanism 5 also includes a pair of second transport rollers 10*b* having an upper roller and a lower roller at a position downstream of the medium support platform 6 in the X direction. By driving these pairs of the transport rollers 10*a*, 10*b*, a recording medium S supplied from a supply region of the apparatus is transported over the medium support platform 6 toward a discharge region of the apparatus while the recording medium S is nipped by the upper and lower rollers. The transport mechanism may be formed by using an endless belt or a drum. In such a case, the belt or the drum serves as the medium support platform. The medium support platform may be formed so as to absorb a recording medium electrostatically or by using a suction pump that produces negative pressure.

Figure 2:
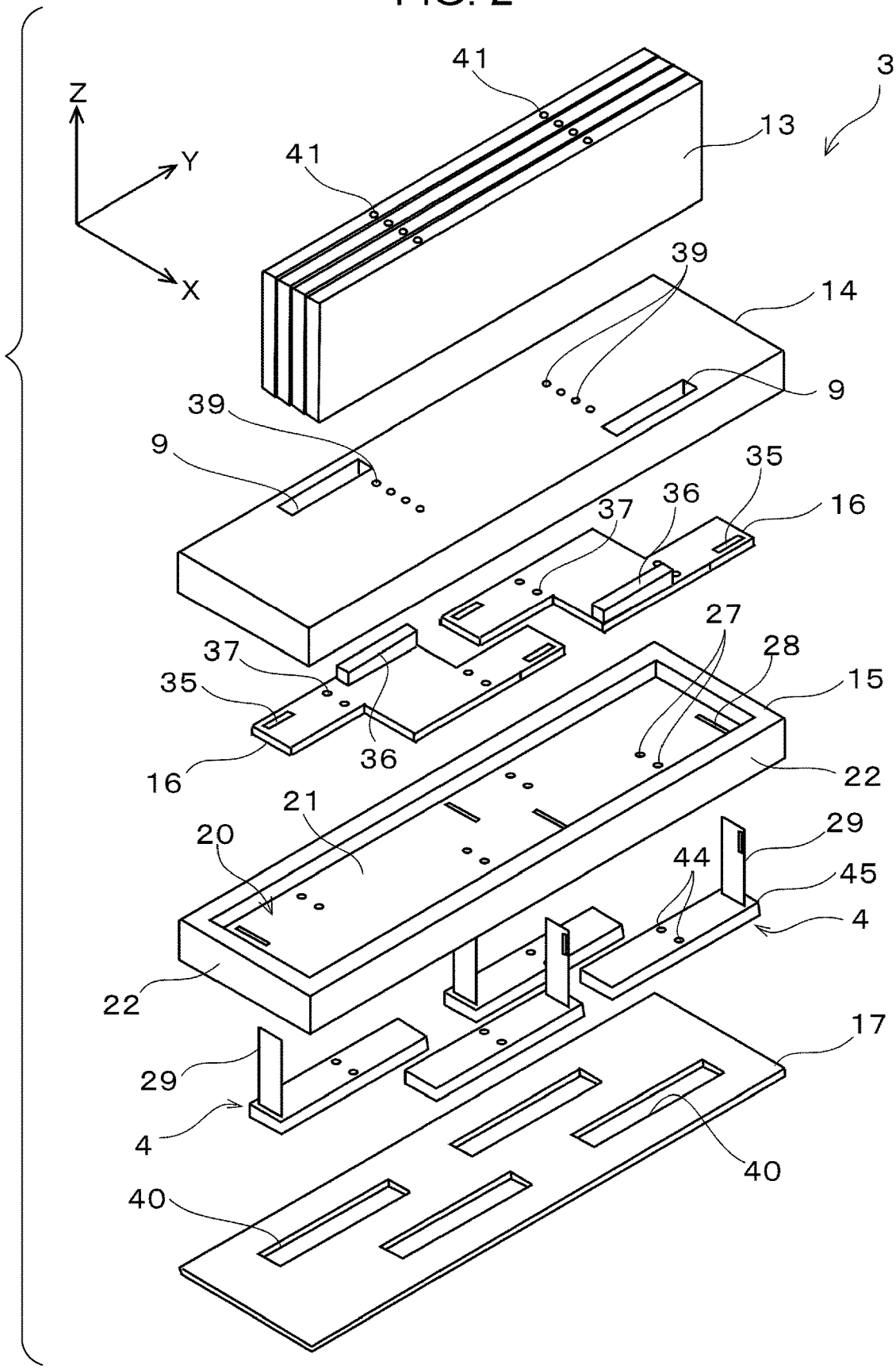
FIG. 2 is an exploded perspective view illustrating the example of the liquid ejecting head.
Figure 3:
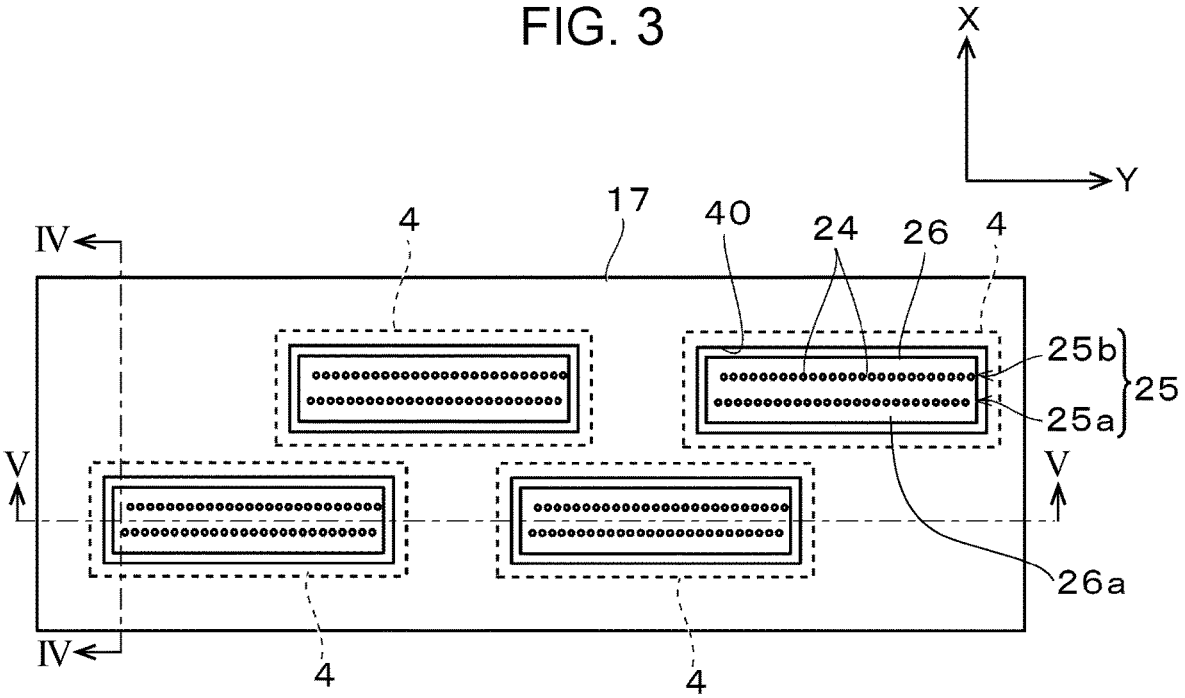
FIG. 3 is a bottom view illustrating the example of the liquid ejecting head.
Figure 4:
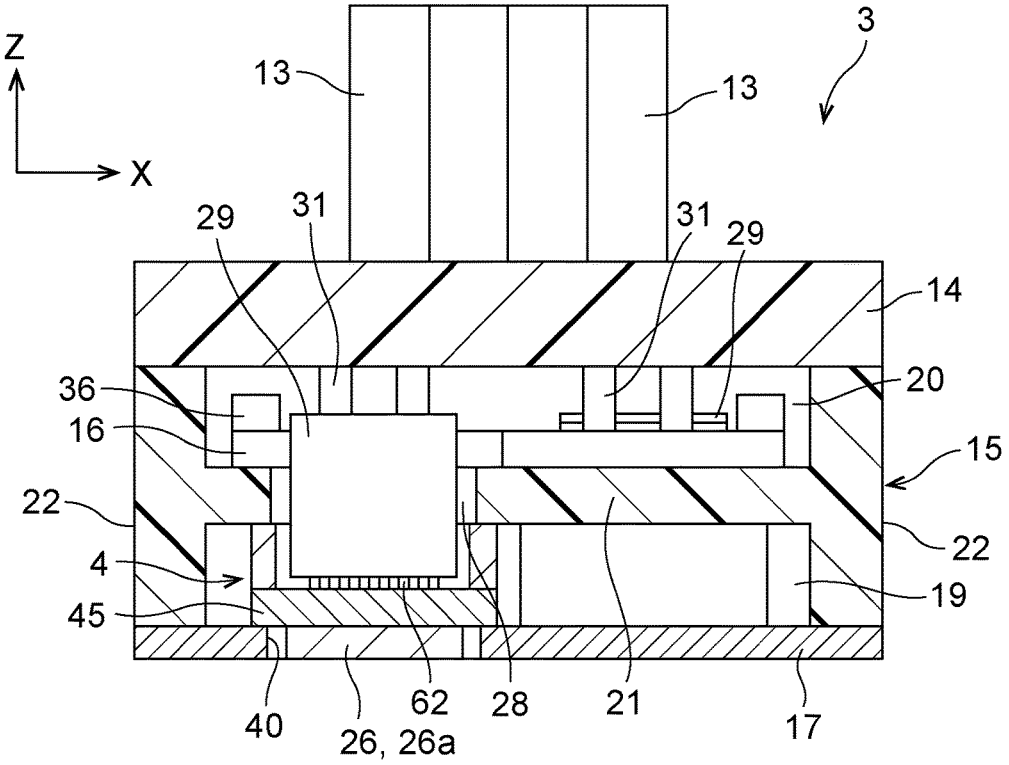
FIG. 4 is a cross-sectional view of the example of the liquid ejecting head taken along line IV-IV in FIG. 3.
Figure 5:
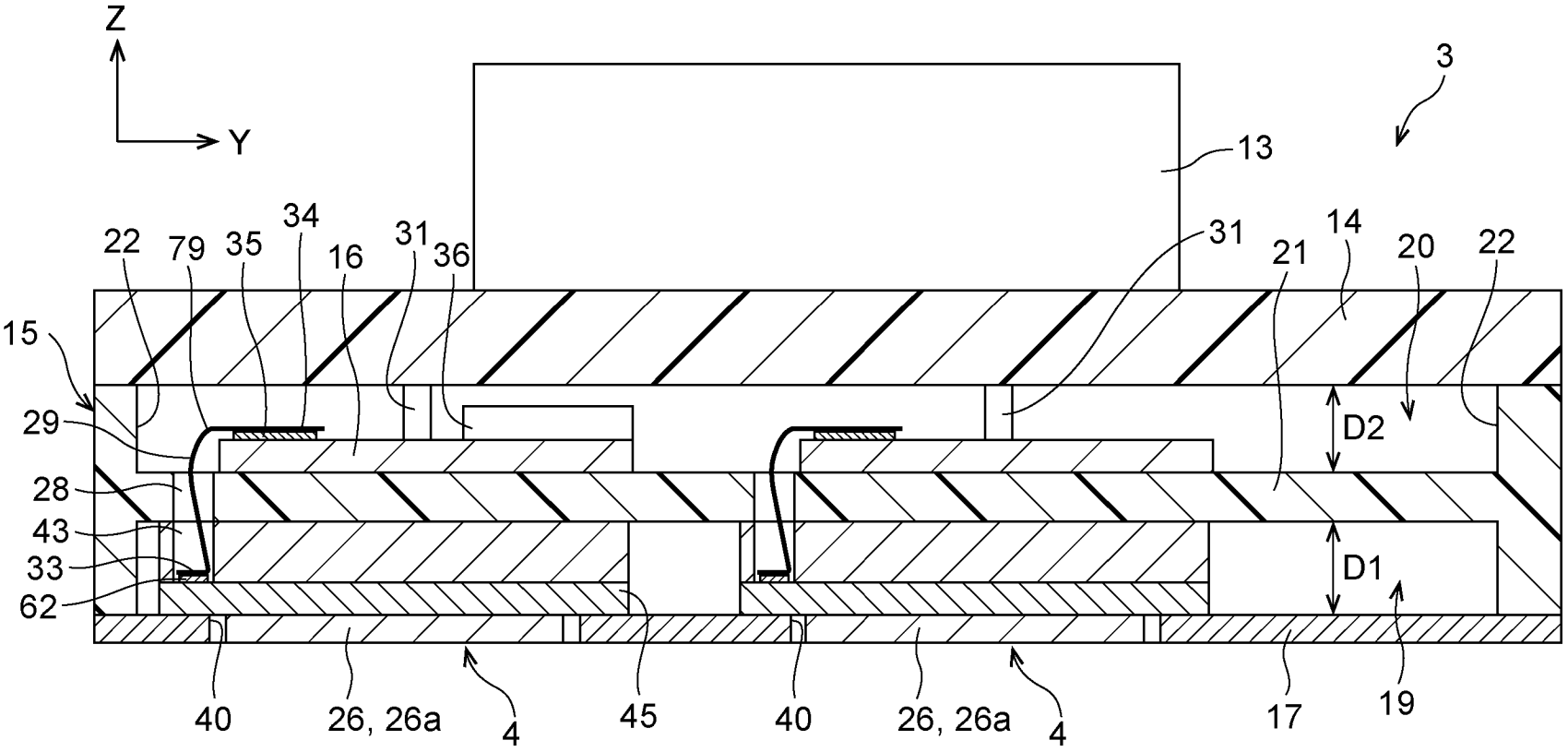
FIG. 5 is a cross-sectional view of the example of the liquid ejecting head taken along line V-V in FIG. 3.

FIG. 2 is an exploded perspective view illustrating the recording head 3 when viewed obliquely from above. FIG. 3 is a bottom view of the recording head 3. FIG. 4 is a cross-sectional view of the recording head 3 taken along line IV-IV in FIG. 3 (i.e., a cross-sectional view in the X direction). FIG. 5 is a cross-sectional view of the recording head 3 taken along line V-V in FIG. 3 (i.e., a cross-sectional view in the Y direction). The recording head 3 according to the embodiment includes flow path members 13 that include flow paths formed therein to supply ink to respective head units 4, a cover member 14, a holder member 15, the circuit substrates 16, the head units 4, and a base plate 17.

The holder member 15 is a member having a substantially cuboid shape. The holder member 15 extends more in the Y direction than in the X direction when viewed in the Z direction. The holder member 15 is made of, for example, synthetic resin. The holder member 15 has a first accommodation recess 19 (which corresponds to a first recess according to the invention) formed on the bottom side thereof (which corresponds to a first side according to the invention). The first accommodation recess 19 has a plurality of head units 4. The holder member 15 also has a second accommodation recess 20 (which corresponds to a second recess according to the invention) formed on the top side thereof (which corresponds to a second side according to the invention). The second accommodation recess 20 accommodates the circuit substrates 16. The second accommodation recess 20 is separated from the first accommodation recess 19 by a partition wall 21. Side walls 22 are formed around the partition wall 21. The side walls 22 are placed in a direction intersecting the partition wall 21. The side walls 22 are placed at four edges of the partition wall 21 and extend toward both sides of the partition wall 21, in other words, toward the side of the first accommodation recess 19 and the side of the second accommodation recess 20 of the partition wall 21. Thus, as illustrated in FIGS. 4 and 5, the holder member 15 looks substantially like a letter "H" when viewed in cross section. In addition, the depth D1 of the first accommodation recess 19 and the depth D2 of the second accommodation recess 20 are substantially the same. More specifically, the depths D1 and D2 are each set within a range of 80% or more and 120% or less of a median value of the depths of the accommodation recesses 19, 20 that are specified in design. More desirably, the depths D1 and D2 fall within a range of 95% or more and 105% or less of the median value. The accommodation recesses 19, 20 are formed on respective top and bottom sides of the holder member 15. Thus, the side walls 22 function as bearing walls and prevent the partition wall 21 from deforming. In addition, since the depths D1 and D2 are substantially the same, in other words, the height of the side walls 22 from the partition wall 21 on the side of the first accommodation recess 19 and the height of the side walls 22 from the partition wall 21 on the side of the second accommodation recess 20 are substantially the same, the strength distribution of structures, such as walls, that define the accommodation recesses 19, 20 is likely to remain balanced. This efficiently reduces deformation of the holder member 15 that extends longitudinally in the Y direction.

The first accommodation recess 19 is a recess that opens downward from the bottom side of the holder member 15, which accommodates a plurality of head units 4 that are fixed to the base plate 17. In other words, the bottom side opening of the first accommodation recess 19 is closed by the base plate 17. The head units 4 are accommodated in a space defined by the first accommodation recess 19 and the base plate 17. Note that the first accommodation recess 19 may be provided for each of the head units 4 or may be provided continuously for a plurality of head units 4. Also note that the holder member 15 is regarded as a type of common member that serves the head units 4 in common.

The head units 4, each of which extends more in the Y direction than in the X direction when viewed in plan view, are disposed in the holder member 15 in the Y direction in a staggered manner. Each of the head units 4 is a head chip that includes, as a single unit, mainly a nozzle plate 26 having nozzle rows 25*a*, 25*b* in which a plurality of nozzles 24 are arranged in the Y direction, a flow path-forming substrate 45 in which flow paths, such as pressure chambers 51, are formed, and piezoelectric elements 60 that function as drive sources (i.e., actuators) for ejecting ink from the nozzles 24. As illustrated in FIG. 3, the head units 4, each of which is oriented with the nozzle rows 25 in the Y direction (i.e., with the longitudinal direction of each head unit 4 being the Y direction), are arranged linearly in the Y direction, while the positions of the head units 4 in the X direction, in other words, in the transport direction of a recording medium S, are staggered. The recording head 3 can be extended by arranging, in the Y direction, the head units 4 each of which extends longitudinally in the Y direction. Thus, a large size recording head 3, otherwise called a "large format head", can be obtained. Note that the positional relationship between adjacent head units 4 is such that some nozzles 24 in the nozzle rows 25 of one head unit 4 are located, in the Y direction, at positions similar to some nozzles 24 in the nozzle rows 25 of the other head units 4. A continuous row of the nozzles 24 can be thereby formed in the Y direction. Note that in this embodiment, a configuration including a total of four head units 4 is described by way of example. However, the number of head units 4 is not limited to four.

As illustrated in FIG. 2, the partition wall 21 of the holder member 15 includes communication flow paths 27 for supplying ink from the cover member 14 toward the head units 4. The communication flow paths 27 are formed so as to extend through the partition wall 21 in the thickness direction, in other words, in the Z direction. The cover member 14 has flow path connectors 31 (see FIGS. 4 and 5) that protrude downward from the bottom side of the cover member 14, and the flow path connectors 31 are connected to the openings of the communication flow paths 27 in the second accommodation recess 20. In the embodiment, two communication flow paths 27 are provided for each of the head units 4. The partition wall 21 has flexible cable through-holes 28 through which flexible cables 29 of respective head units 4 are inserted. The flexible cable through-holes 28 are formed so as to extend through the partition wall 21 in the thickness direction. The flexible cables 29 of the head units 4 accommodated in the first accommodation recess 19 are inserted through respective flexible cable through-holes 28 from the bottom side of the partition wall 21, in other words, from the side of the first accommodation recess 19, and pass out on the top side of the partition wall 21, in other words, on the side of the second accommodation recess 20.

The second accommodation recess 20 accommodates the circuit substrates 16. Each of the circuit substrates 16 is formed of a rigid printed substrate on which electronic parts, wiring, and other components are disposed. In the embodiment, one circuit substrate 16 is provided per two respective head units 4. Accordingly, two circuit substrates 16 are disposed in the second accommodation recess 20. Note that the provision of the circuit substrates 16 is not limited to the configuration of one circuit substrate 16 for two head units 4. A single circuit substrate 16 may be provided for each of the head units 4, or a common circuit substrate 16 may be provided for all the head units 4 disposed in the second accommodation recess 20. In the configuration in which a plurality of the circuit substrates 16 are provided, the size of each circuit substrate 16 can be reduced compared with the common circuit substrate 16, which can reduce warping of each individual circuit substrate 16. This also reduces the likelihood of a flexible cable 29 at an installation portion detaching from a circuit substrate 16.

As illustrated in FIG. 2, when viewed in the Z direction, the circuit substrate 16 according to the embodiment has a crank shape which follows the layout of a corresponding two head units 4. On the top side of each circuit substrate 16 (i.e., the side opposing the cover member 14), a circuit substrate terminal section 35 is disposed for the connection with a second terminal section 34 of the flexible cable 29. In the embodiment, the circuit substrate terminal section 35 extends more in the Y direction than in the X direction when viewed in plan view. In other words, terminals that constitute the circuit substrate terminal section 35 are arranged in the Y direction. In addition, through-holes 37 are provided in the circuit substrate 16 at positions corresponding to the communication flow paths 27 of the holder member 15. The flow path connectors 31 of the cover member 14 are inserted into respective through-holes 37. In other words, the flow path connectors 31 of the cover member 14 are connected to the communication flow paths 27 via the through-holes 37. Moreover, a connector 36 is disposed on the top side of the circuit substrate 16. The external connection cable is inserted into the second accommodation recess 20 through the cable insertion opening 9 and connected to the connector 36.

The cover member 14 is a member having a cuboid shape. The cover member 14 extends more in the Y direction than in the X direction when viewed in plan view. The cover member 14 is made of synthetic resin as is the holder member 15. The cover member 14 closes the top opening of the second accommodation recess 20 of the holder member 15. In this state, the cover member 14 is fixed to the holder member 15 by a fixing method, such as adhesion with an adhesive, fixation with screws, or welding. Supply flow paths 39 that supply ink to respective communication flow paths 27 of the holder member 15 are provided inside the cover member 14. Each of the supply flow paths 39 extends in the cover member 14 in the up-down direction from the opening of the supply flow path 39 on the top side of the cover member 14 to a corresponding communication flow path 27 of the holder member 15. A downstream portion of the supply flow path 39 is formed within a corresponding flow path connector 31 that protrudes from the bottom side of the cover member 14 and opens at an end of the flow path connector 31 (the end connected to a corresponding communication flow path 27).

The base plate 17 is a metal plate that extends more in the Y direction than in the X direction when viewed in plan view. The base plate 17 closes the opening of the first accommodation recess 19 and is fixed to the bottom side of the holder member 15 by using an adhesive or the like. Openings 40 that expose nozzle faces 26*a* of the head units 4 (see FIG. 3) are provided for respective head units 4 in the base plate 17. Each head unit 4 is fixed, by using an adhesive or the like, to an area surrounding a corresponding opening 40 on the top side of the base plate 17 (i.e., the side facing the first accommodation recess 19). The base plate 17 according to the embodiment functions as a type of common member that serves a plurality of the head units 4 commonly. The base plate 17 and the cover member 14 are fixed indirectly to each other via the holder member 15. Thus, the circuit substrates 16 are placed between, and covered with, the base plate 17 and the cover member 14. The circuit substrates 16 are thereby protected from ink, dust, or the like.

In the embodiment, a total of four flow path members 13 are disposed side by side in the X direction on the top side of the cover member 14. Inflow ports 41 that correspond to respective liquid supply tubes 8 open on the top side of the flow path members 13. The inflow ports 41 are in communication with the supply flow paths 39 that open on the top side of the cover member 14 via liquid flow paths formed inside the flow path members 13. These flow path members 13 have the function of regulating the supply pressure of ink supplied from the liquid supply tubes 8 toward the head units 4 as well as filtering the ink by using filters (not illustrated). Ink is thus supplied from the flow path members 13 to the head units 4 through the supply flow paths 39 and the communication flow paths 27.

Figure 6:
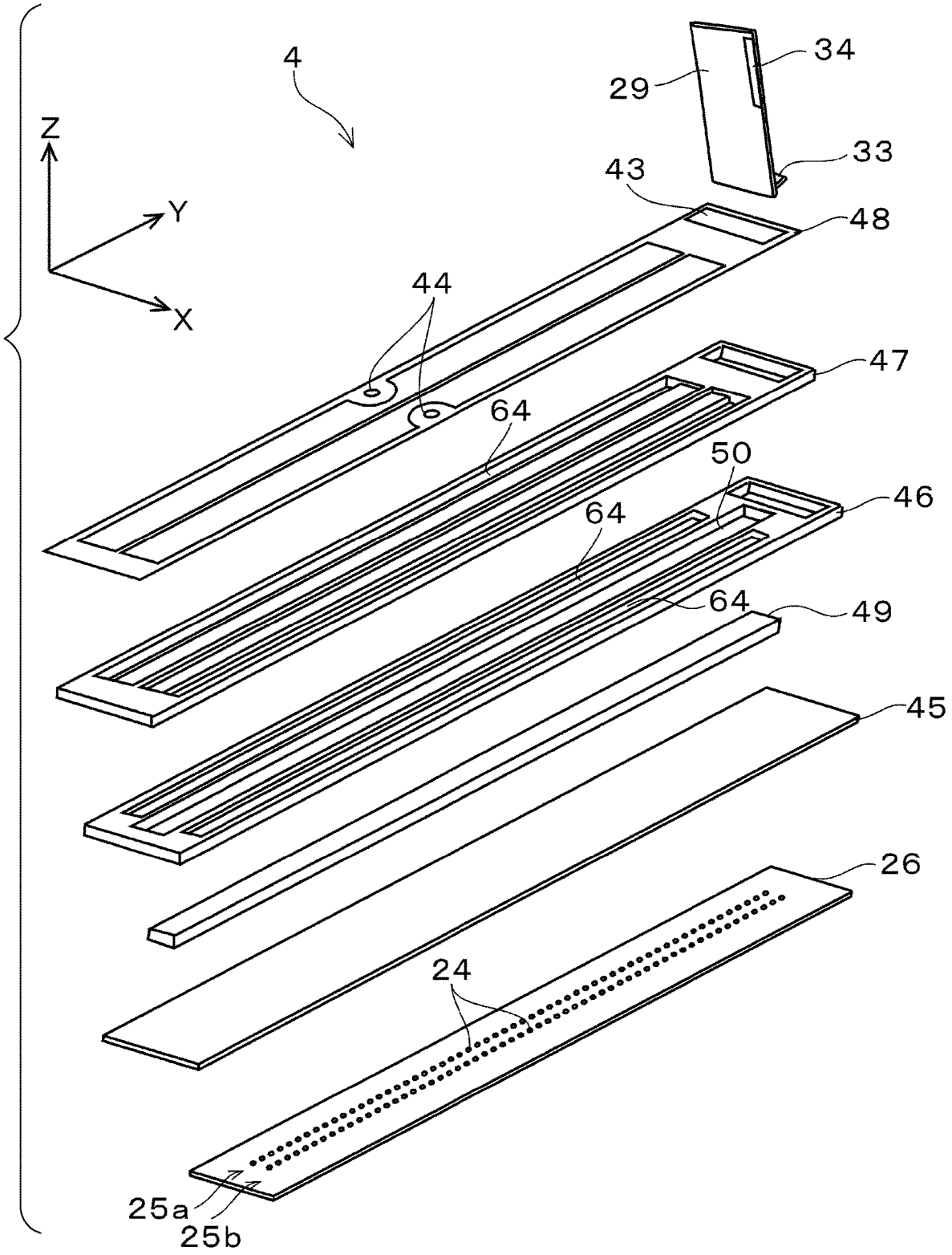
FIG. 6 is an exploded perspective view illustrating an example of a head unit.
Figure 7:
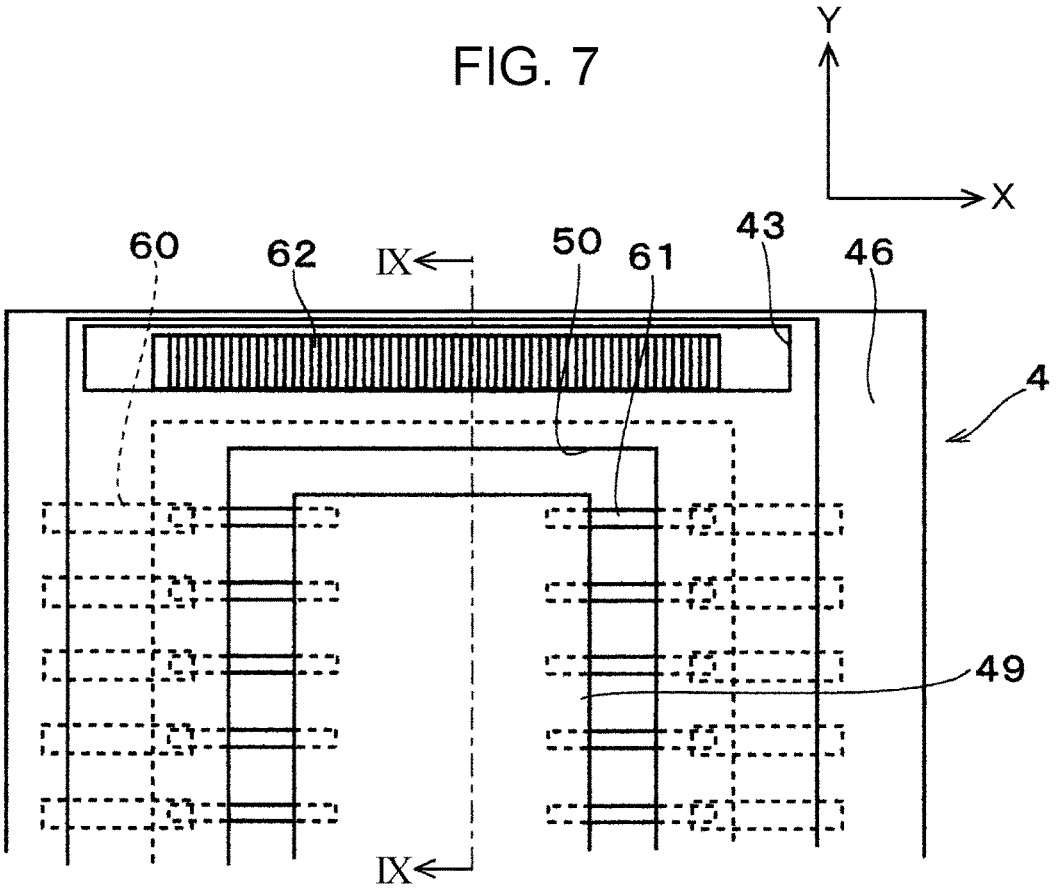
FIG. 7 is a partial plan view illustrating the head unit.
Figure 8:
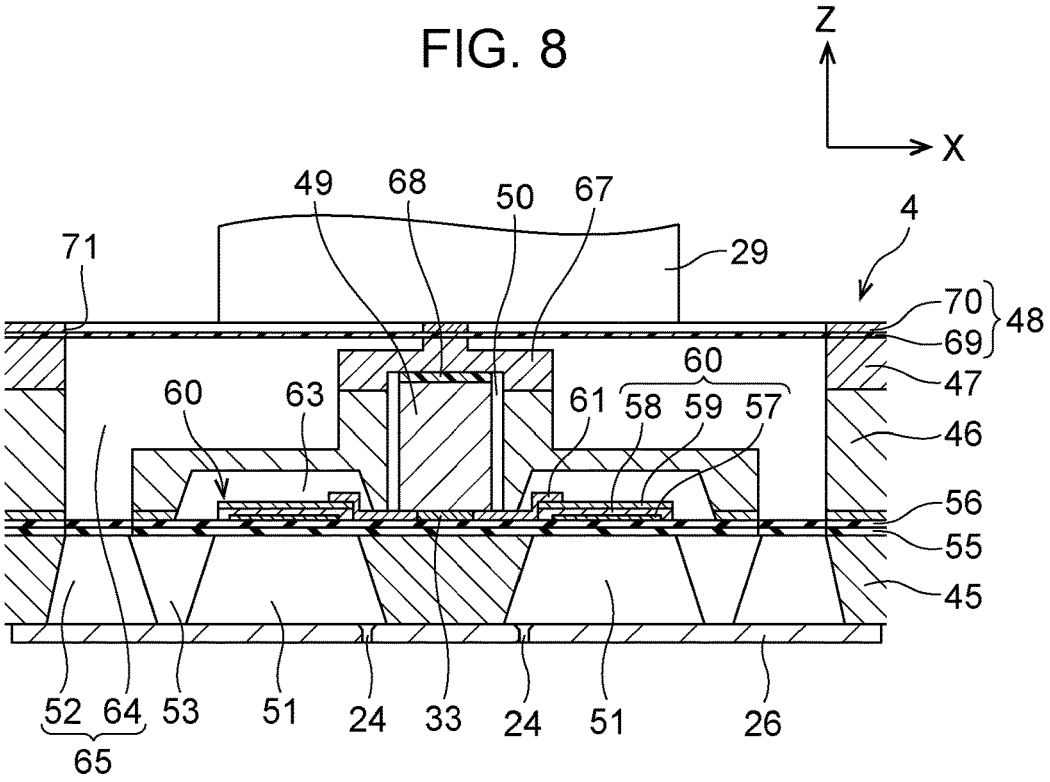
FIG. 8 is a cross-sectional view illustrating the head unit cut in the X direction.
Figure 9:
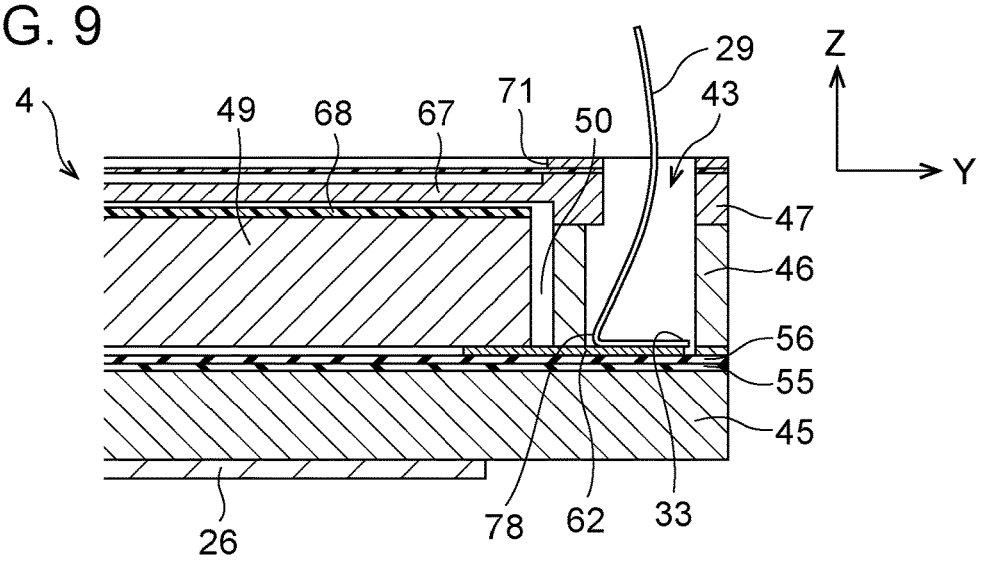
FIG. 9 is a cross-sectional view of the head unit taken along line IX-IX in FIG. 7.

FIG. 6 is an exploded perspective view illustrating an example of a head unit 4. FIG. 7 is a plan view illustrating part of the head unit 4 (i.e., a portion near an accommodation space 50, which will be described later). In FIG. 7, a reservoir-forming substrate 47, a compliance substrate 48, and the flexible cable 29 are not illustrated. In addition, FIG. 8 is a cross-sectional view illustrating the head unit 4 cut in the X direction. FIG. 9 is a cross-sectional view of the head unit 4 taken along line IX-IX in FIG. 7. The head unit 4 according to the embodiment is shaped like a cuboid, which extends more in the Y direction than in the X direction when viewed in plan view. On the top side of the head unit 4 (i.e., on the side facing the partition wall 21 when installed in the first accommodation recess 19), a cable opening 43 is provided at a longitudinal end in the Y direction. A flexible cable 29, which serves as a wiring substrate, is inserted into the cable opening 43. Two ink inlets 44 are provided at a center portion in the Y direction on the top side of the head unit 4. The ink inlets 44 are in communication with the communication flow paths 27, and ink supplied from a flow path member 13 is introduced through the ink inlets 44.

The head unit 4 according to the embodiment includes a flow path-forming substrate 45 (a type of head substrate according to the invention), a nozzle plate 26, a protection substrate 46, a reservoir-forming substrate 47, a compliance substrate 48, an activation IC 49, and a flexible cable 29. The nozzle plate 26, the flow path-forming substrate 45, and the protection substrate 46 are stacked in this order by using an adhesive or the like. The reservoir-forming substrate 47 and the compliance substrate 48 are further stacked on top of the protection substrate 46 in this order. The activation IC 49 is disposed in an accommodation space 50 formed in the protection substrate 46 between the flow path-forming substrate 45 and the reservoir-forming substrate 47.

The flow path-forming substrate 45 is formed, for example, of a single-crystal silicon substrate. A plurality of pressure chambers 51 are disposed in the flow path-forming substrate 45 at positions corresponding to respective nozzles 24. The pressure chambers 51 are provided in rows extending in the Y direction. The pressure chambers 51 are formed by anisotropic etching. In the embodiment, two rows of the pressure chambers 51, which correspond to the two nozzle rows 25 formed on the nozzle plate 26, are formed in the flow path-forming substrate 45. In the flow path-forming substrate 45, a communication section 52, which serves as a liquid supply path, is formed in a region located outside the pressure chambers 51 in the X direction. The communication section 52 is in communication with each pressure chamber 51 via an ink supply path 53 provided for each pressure chamber 51. The width of the ink supply path 53 is narrower than that of the pressure chamber 51 so as to impart flow path resistance to the ink flowing into the pressure chamber 51 from the communication section 52.

In each pressure chamber 51, a nozzle 24 is perforated in the nozzle plate 26 at a position opposite to the ink supply path 53. The nozzle plate 26 is formed of a material, such as glass ceramics, a single crystal silicon substrate, or stainless steel. In the embodiment, the size of the nozzle plate 26 is smaller than the size of the flow path-forming substrate 45. The flow path-forming substrate 45 and the nozzle plate 26 are joined to each other by using an adhesive, a heat-welding film, or the like. In the nozzle plate 26, the nozzle face is the bottom side of the plate, which is opposite to the side to which the flow path-forming substrate 45 is joined. In the embodiment, the nozzle plate 26 is joined to the bottom of the flow path-forming substrate 45 substantially at the center thereof. The base plate 17 is fixed to an area surrounding the nozzle plate 26. In other words, when the base plate 17 is fixed to the bottom surface of the flow path-forming substrate 45, the nozzle plate 26 is positioned in an opening 40 formed in the base plate 17 (see FIGS. 3 to 5).

In the flow path-forming substrate 45, an elastic membrane 55 that constitutes a vibrating plate is formed on a side opposite to the side to which the nozzle plate 26 is joined. The elastic membrane 55 is formed of, for example, silicon dioxide. An insulation membrane 56 made of an oxide film is formed on the elastic membrane 55. The insulation membrane 56 consists of, for example, zirconium oxide. Thus, the vibrating plate is constituted by the elastic membrane 55 and the insulation membrane 56.

Piezoelectric elements 60 are formed on the insulation membrane 56. Each piezoelectric element 60 includes a bottom electrode 57 formed of a metal such as platinum (Pt) or of a metal oxide such as strontium ruthenate (SrRuO), a piezoelectric layer 58 having the perovskite structure, and a top electrode 59 formed of a metal such as gold (Au) or iridium (Ir). In general, one of the electrodes of the piezoelectric element 60 is formed as a common electrode, and the other electrode and the piezoelectric layer 58 are patterned on the substrate so as to correspond to each pressure chamber 51. A portion of the piezoelectric element that produces a piezoelectric strain when a drive voltage is applied to the electrodes 57, 59 functions as the active portion of the piezoelectric element. In the embodiment, the bottom electrode 57 serves as the common electrode for the piezoelectric elements 60, and the top electrode 59 serves as an individual electrode for each piezoelectric element 60. However, due to the constraints of the activation IC 49 or wiring, the bottom electrode 57 may serve as the individual electrode for each piezoelectric element 60, and the top electrode 59 may serve as the common electrode for the piezoelectric elements 60. In any cases, the active portion of the piezoelectric element is formed for each of the pressure chambers 51. Actuation of the piezoelectric element 60 displaces the vibrating plate that is formed of the elastic membrane 55 and the insulation membrane 56. The piezoelectric element 60 and the vibrating plate function as an actuator here.

A lead electrode 61 is connected to the top electrode 59 of each piezoelectric element 60. The lead electrode 61 is made of, for example, gold (Au) and extends to a region between the rows of the pressure chambers 51. The lead electrode 61 is formed for each piezoelectric element 60 by patterning a metal layer that is made of, for example, gold (Au).

The protection substrate 46 has piezoelectric element accommodation spaces 63 at regions opposing the piezoelectric elements 60, which are spaces large enough to allow respective piezoelectric elements 60 to deform without hindrance. Two piezoelectric element accommodation spaces 63 are provided so as to correspond to two rows of the pressure chambers 51. The protection substrate 46 is adhered by an adhesive or the like to the flow path-forming substrate 45 on which the piezoelectric elements 60 are formed. The protection substrate 46 can be made of, for example, glass, ceramics, resin, or a silicon substrate. In the protection substrate 46, an ink retention space 64 is formed so as to encompass a region corresponding to the communication section 52 of the flow path-forming substrate 45 and a region above the piezoelectric element accommodation space 63. The ink retention space 64 according to the embodiment is continuously formed along each row of the pressure chambers 51. The ink retention space 64, which is in communication with the communication section 52 of the flow path-forming substrate 45, constitutes a reservoir 65 (otherwise called a "manifold") that serves the pressure chambers 51 as a common ink retention chamber.

The accommodation space 50 is provided in the protection substrate 46 in the region between the rows of the pressure chambers 51. The accommodation space 50 passes through the protection substrate 46 in the thickness direction, in other words, in the Z direction. End portions of the lead electrodes 61 taken out from respective piezoelectric elements 60 are exposed at the bottom of the accommodation space 50. The activation IC 49 according to the embodiment is accommodated in the accommodation space 50. The activation IC 49 is mounted on the end portions of the lead electrodes 61 exposed in the accommodation space 50, and output terminals (not illustrated) of the activation IC 49 are electrically connected to the end portions of the lead electrodes 61. A head substrate terminal section 62 that is electrically connected to input terminals (not illustrated) of the activation IC 49 is disposed on the flow path-forming substrate 45. The head substrate terminal section 62 extends to a position corresponding to the cable opening 43 (see FIGS. 7 and 9). The head substrate terminal section 62 is formed of a plurality of terminals that are arranged side by side in the X direction. The head substrate terminal section 62 is formed, in a strict sense, on the vibrating plate (i.e., the elastic membrane 55 and the insulation membrane 56) that is stacked on the flow path-forming substrate 45. However, for convenience, the head substrate terminal section 62 is regarded to be formed, although indirectly, on the flow path-forming substrate 45. The head substrate terminal section 62 is provided for the connection with a first terminal section 33 of the flexible cable 29 that is inserted into the cable opening 43. The head substrate terminal section 62 is disposed on the flow path-forming substrate 45 at a position away from the center of the flow path-forming substrate 45 toward one end thereof in the Y direction when viewed in plan view. The flexible cable 29 will be described in detail later.

The reservoir-forming substrate 47 is disposed on top of the protection substrate 46. In a substantially mid portion of the reservoir-forming substrate 47, a beam 67 is formed so as to extend in the Y direction and cover the top portion of the accommodation space 50. A heat conductor 68 is disposed between the beam 67 and the activation IC 49 so as to be in contact with both of these components. To form the heat conductor 68, resin such as an adhesive, silicone grease, grease having a high content of ceramic filler, a heat radiation sheet can be used.

The compliance substrate 48 is joined to the top side of the reservoir-forming substrate 47. The compliance substrate 48 is formed of a sealing membrane 69 and a supporting plate 70. The sealing membrane 69 is made of a material having flexibility (for example, a polyphenylene sulfide (PPS) film having a thickness of several micrometers). The sealing membrane 69 seals one side of the ink retention space 64, thereby forming the reservoir 65. The supporting plate 70 is formed of a rigid material such as a metal, for example, a stainless-steel sheet (SUS series steel in accordance with Japanese Industrial Standards (JIS)) having a thickness of several tens of micrometers. Regions of the supporting plate 70 that face respective ink retention spaces 64 are completely removed so as to form through-opening 71 in the Z direction, in other words, in the thickness direction. Accordingly, the one side of each ink retention space 64 is sealed only by the sealing membrane 69 having flexibility.

In the head unit 4 formed in such a manner, the flow paths from reservoir 65 to the nozzles 24 are filled with ink that is taken in from one of the flow path members 13. In this state, signals including drive signals are transmitted from the control unit of the printer 1 to the activation IC 49 via the circuit substrate 16 and the flexible cable 29. Drive signals are selectively applied to the piezoelectric elements 60 under the control of the activation IC 49. Each piezoelectric element 60 deforms in response to the waveform of an applied drive signal, and this deformation generates a pressure fluctuation in the pressure chamber 51. The pressure fluctuation causes the nozzle 24 to eject an ink droplet. Note that the configuration of the head unit 4 is not limited to the example described above. The head unit 4 may be formed in various ways. For example, the compliance substrate 48 is described, by way of example, as being disposed on the top side of the head unit 4. However, the compliance substrate 48 may be disposed on the bottom side of the flow path-forming substrate 45. In this configuration, the compliance substrate 48 having an opening for exposing each nozzle plate 26 is fixed to an area surrounding the nozzle plate 26 that is joined to a substantially middle portion on the bottom side of the flow path-forming substrate 45. In this case, the base plate 17 is joined to the compliance substrate 48, and the opening 40 of the base plate 17 exposes only the nozzle plate 26.

Figure 10:
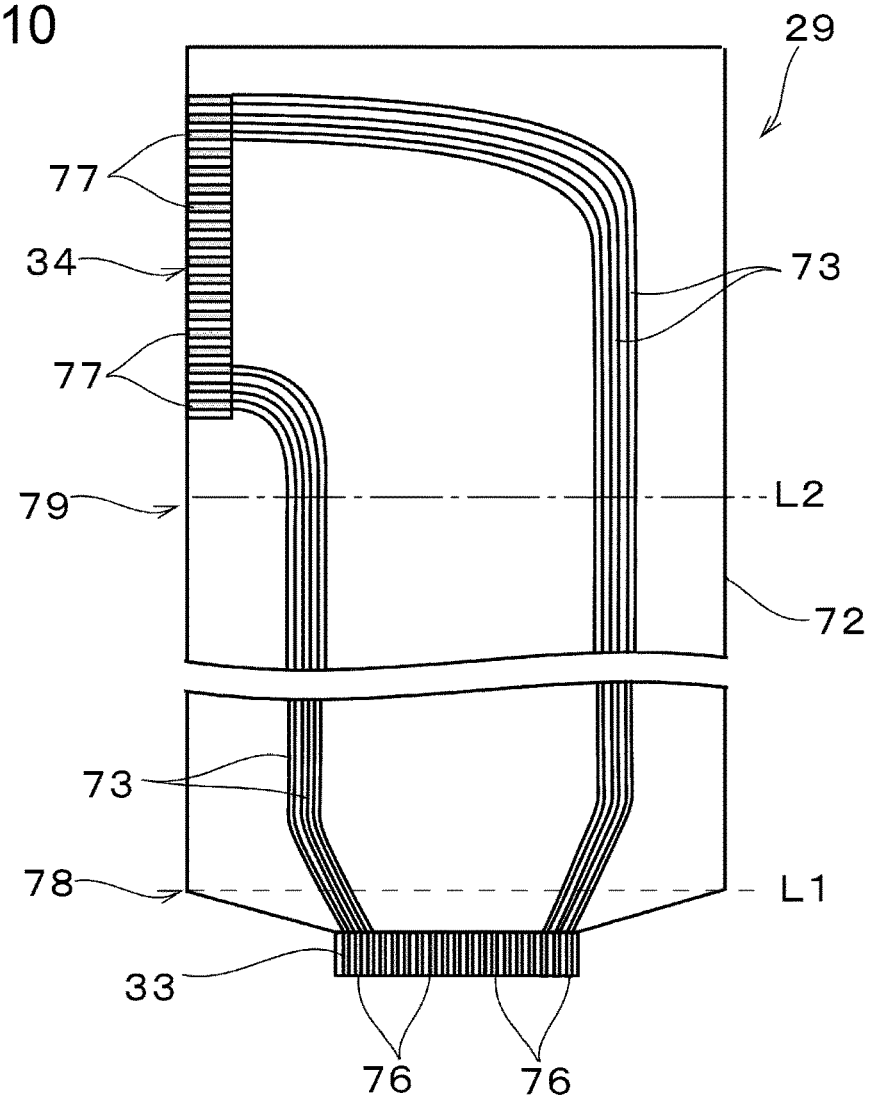
FIG. 10 is a front view illustrating a structure of an example of a flexible cable.

FIG. 10 is a front view illustrating a structure of an example of the flexible cable 29. The flexible cable 29 according to the invention includes a rectangular base film 72 that is made of polyimide or the like and terminal sections 33, 34 and a pattern of conductors 73 that are formed on one side of the base film 72. FIG. 10 illustrates only a portion of the conductors 73. A first terminal section 33 is formed at one end (hereinafter referred to as "first end") of the flexible cable 29 (i.e., at the bottom end of the flexible cable 29 in FIG. 10). The first terminal section 33 is connected to the head substrate terminal section 62. The first terminal section 33 includes a plurality of first terminals 76 that are arranged in the width direction of the flexible cable 29, in other words, in the X direction when the flexible cable 29 is connected to the head unit 4. The first terminal section 33 extends more in the X direction than in the Y direction. Accordingly, the conductors 73 at the first end of the flexible cable 29 are also arranged side by side in the width direction of the flexible cable 29.

The second terminal section 34 is formed at the other end (hereinafter referred to as "second end") of the flexible cable 29 and at a side edge of the flexible cable 29 in the width direction thereof (i.e., the left edge of the flexible cable 29 in FIG. 10). The second terminal section 34 extends in the longitudinal direction of the flexible cable 29 and is connected to the circuit substrate terminal section 35 of the circuit substrate 16. The second terminal section 34 includes a plurality of second terminals 77 that are arranged side by side in the longitudinal direction of the base film 72. Accordingly, the second terminal section 34 extends more in the longitudinal direction. The conductors 73 at the second end of the flexible cable 29 are also arranged side by side in the longitudinal direction of the flexible cable 29.

As described above, the conductors 73 at the first end of the flexible cable 29 are arranged in the width direction of the flexible cable 29, which enables a reduction in the length, in the X direction, of a fixation region where the first end of the flexible cable 29 is fixed to the flow path-forming substrate 45. The size of the head unit 4 in the X direction can be thereby reduced. It is desirable that the width of the flexible cable 29 be less than the width of the head unit 4 in the X direction. The head units 4 can be thereby arranged densely without being restrained by the size (especially the width) of the flexible cable 29. On the other hand, the conductors are arranged in the longitudinal direction at the second end of the flexible cable 29, which increases freedom in wiring layout or the like at the second end. In other words, the pitch and thickness of the conductors 73 can be set flexibly at the second end as described below.

The width of each first terminal 76 (i.e., the width of each terminal in the arrangement direction of the terminals) is less than the width of each second terminal 77. Accordingly, the thickness of each of the conductors 73 that connect between the terminals 76 and the terminals 77 is relatively small near the first terminals 76 (i.e., near the first end) and large near the second terminals 77 (i.e., near the second end). The pitch of the first terminals 76 is narrower than the pitch of the second terminals 77. Accordingly, the pitch of the conductors 73 is relatively narrow near the first terminals 76 and wide near the second terminals 77. By adopting this configuration, the width of the first terminal section 33 at the first end of the flexible cable 29 can be reduced. This leads to a reduction in the size of the head substrate terminal section 62 of the flow path-forming substrate 45 in the X direction, to which the first terminal section 33 is connected. This consequently leads to a reduction in the size of the head unit 4 in the X direction. The thickness of each of the conductors 73 is larger at the second end of the flexible cable 29 than that at the first end, thereby reducing the resistance of the conductors. Especially in the embodiment, the more distant the conductors 73 at the second end are from the first terminal section 33 at the first end, the longer the conductors 73, and thus, the higher the resistance of the conductors 73 tends to be. By increasing the thickness of each of the conductors 73, an increase in resistance can be suppressed. Moreover, the larger pitch of the conductors 73 near the second end, compared with the pitch near the first end, can facilitate the connection work of the second end to the circuit substrate 16. This reduces the likelihood of electric failures such as a loose connection occurring.

The first terminal section 33 of the first end of the flexible cable 29 is connected to the head substrate terminal section 62 of the flow path-forming substrate 45. When installing the flexible cable 29 to the head substrate terminal section 62, the first end of the flexible cable 29 is bent, for example, at a virtual folding line L1 (see FIG. 10) toward a side of the flexible cable 29 (i.e., a mountain fold) that is opposite to the side on which the terminal sections 33, 34 and the conductors 73 are formed (see FIGS. 5, 6, and 9). The bent portion at the folding line L1 is hereinafter referred to as the first curved portion 78. The flexible cable 29 thereby assumes a state where a portion of the flexible cable 29 from the first curved portion 78 to the first terminal section 33 is placed along the flow path-forming substrate 45, in other words, the head substrate, and opposes the head substrate terminal section 62. In the embodiment, the portion of the flexible cable 29 from the first curved portion 78 to the first terminal section 33 is referred to as the portion of the flexible cable 29 that extends along the flow path-forming substrate 45, which is the head substrate. In this case, the portion of the flexible cable 29 from the first curved portion 78 to the second end is the portion that extends in a direction intersecting the flow path-forming substrate 45 (i.e., in a direction away from the flow path-forming substrate 45). When the portion of the flexible cable 29 from the first curved portion 78 to the first terminal section 33 is placed along the first terminal section 33, the portion may not necessarily be parallel to the top side (i.e., installation face) of the flow path-forming substrate 45 but may be closer to parallel to the top side of the flow path-forming substrate 45 compared with the remaining portion of the flexible cable 29. The same applies when a portion of the flexible cable 29 from the second curved portion 79 to the second terminal section 34 is placed along the installation face of the circuit substrate 16, which will be described later. In the embodiment, the first curved portion 78 is exemplified as a sharp bend. However, the first curved portion 78 may be a portion that is curved gently over a wider region (i.e., having a smaller curvature). The same applies to a second curved portion 79, which will be described later.

The first terminal section 33 of the flexible cable 29 and the head substrate terminal section 62 are fixed, and electrically connected, to each other by using, for example, a non-conductive paste (NCP) or a sheet of the non-conductive paste. The first end of the flexible cable 29 is thereby fixed to the flow path-forming substrate 45. The non-conductive paste does not include electroconductive particles. Accordingly, even if gaps between adjacent terminals are relatively small, the terminals of the first terminal section 33 can be connected to the terminals of the head substrate terminal section 62 while short-circuits between adjacent terminals are prevented. This contributes to a high-density arrangement of terminals.

A connection portion that electrically connects between the first terminal section 33 and the head substrate terminal section 62, in other words, the fixation region (i.e., the installation portion) where the flexible cable 29 and the flow path-forming substrate 45 are fixed to each other, extends more in the X direction than in the Y direction when viewed in a direction orthogonally intersecting the installation face of the flow path-forming substrate 45. This means that the first curved portion 78 also extends more in the X direction than in the Y direction. With this configuration, even when the components of the recording head 3 that extend more in the Y direction warp in the same direction due to, for example, a difference between the coefficients of thermal expansion of the components, stress does not tend to act on the installation portion compared with the case where the installation portion and the first curved portion 78 extend more in the Y direction. Thus, even if the recording head 3 includes long components as in the present embodiment, detachment of the first terminal section 33 from the head substrate terminal section 62 at the installation portion, which is constituted by electrical contacts, can be suppressed. This can reduce the likelihood of electric failures such as a loose connection occurring at the installation portion without separately providing a member, such as a correction plate, for suppressing warping of the head components.

A portion of the flexible cable 29 from the first curved portion 78 to the second end is erected so as to extend in a direction away from the flow path-forming substrate 45 toward the circuit substrate 16, in other words, in a direction intersecting the flow path-forming substrate 45. The portion of the flexible cable 29 is subsequently taken out upward through the cable opening 43 of the head unit 4. When the head unit 4 is accommodated in the first accommodation recess 19, the flexible cable 29 taken out from the cable opening 43 is inserted into one of the flexible cable through-hole 28 provided in the partition wall 21 of the holder member 15 and is further taken out to the second accommodation recess 20. The second end of the flexible cable 29, which has been taken out to the second accommodation recess 20, is bent (i.e., a valley fold) at a virtual folding line L2 (see FIG. 10) toward the side on which the terminal sections 33, 34 and the conductors 73 are formed (see FIG. 5). The bent portion at the folding line L2 is hereinafter referred to as the second curved portion 79. In this state, a portion of the flexible cable 29 from the second curved portion 79 to the second terminal section 34 is placed along the installation face of the circuit substrate 16 and opposes the circuit substrate terminal section 35. Here, the portion of the flexible cable 29 from the second curved portion 79 to the first end is a portion that extends in a direction intersecting the circuit substrate 16 (i.e., in a direction away from the circuit substrate 16).

The second terminal section 34 of the flexible cable 29 and the circuit substrate terminal section 35 are fixed, and electrically connected, to each other by using a non-conductive paste or the like, as is the case of the connection between the first terminal section 33 and the head substrate terminal section 62. The second end of the flexible cable 29 is thereby fixed to the circuit substrate terminal section 35. Note that the method of connection between these terminal sections are not limited to that using the non-conductive paste as described by way of example. However, the terminal sections may be connected electrically to each other by using anisotropic conductive paste (ACP) or solder.

As illustrated in FIG. 5, the first terminal section 33 at the first end of the flexible cable 29 is fixed to the head substrate terminal section 62, and the second terminal section 34 at the second end of the flexible cable 29 is fixed to the circuit substrate terminal section 35, thereby completing installation of the flexible cable 29. In this state, the flexible cable 29 is loose between the flow path-forming substrate 45 and the circuit substrate 16. In the embodiment, the length between the first curved portion 78 and the second curved portion 79 is adjusted to an amount of 101% or more to 140% or less of the distance between the top side (i.e., the installation face) of the flow path-forming substrate 45 and the top side (i.e., the installation face) of the circuit substrate 16. The length between the first curved portion 78 and the second curved portion 79 has such an extra amount. Accordingly, even if the components that extend more in the Y direction than in the X direction warp, the extra amount in the length can relieve an impact of warping (i.e., the flexible cable 29 is not readily tightened in the case of warping). As a result, detachment of the flexible cable 29 at the installation portion can be suppressed reliably.

As illustrated in FIGS. 5, 6, and 9, the position at which the flexible cable 29 starts to rise in a direction away from the flow path-forming substrate 45 in each head unit 4 (in other words, the position of the first curved portion 78) is located away from the center of the head unit 4 toward one end thereof in the Y direction. In addition, as illustrated in FIG. 2, the flexible cables 29 that are fixed to the respective flow path-forming substrates 45 of head units 4 located at the farthest ends in the Y direction among a plurality of the head units 4 are disposed, in the Y direction, away from the center of the common members, such as base plate 17 and the holder member 15. The flexible cables 29 tend to generate heat. By disposing the flexible cables 29 away from the center of the common members (or from the center of the recording head 3), in other words, by disposing the flexible cables 29 near the ends of the common members where the temperature tends to decrease (i.e., heat tends to dissipate), the temperature gradient within the recording head 3 can be reduced. As a result, variation in ejection characteristics of each head unit 4 due to temperature fluctuation can be suppressed.

Figure 11:
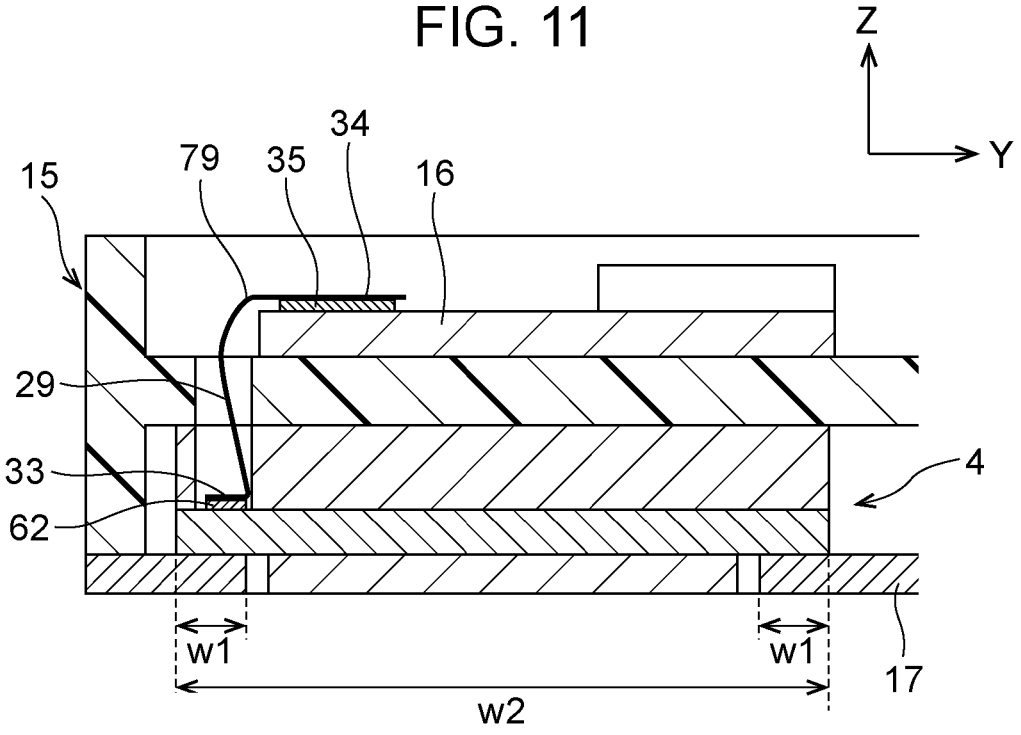
FIG. 11 is a view illustrating a relationship between a fixation region of the flexible cable and a flow path-forming substrate and a fixation region of the flow path-forming substrate and a base plate.
Figure 12:
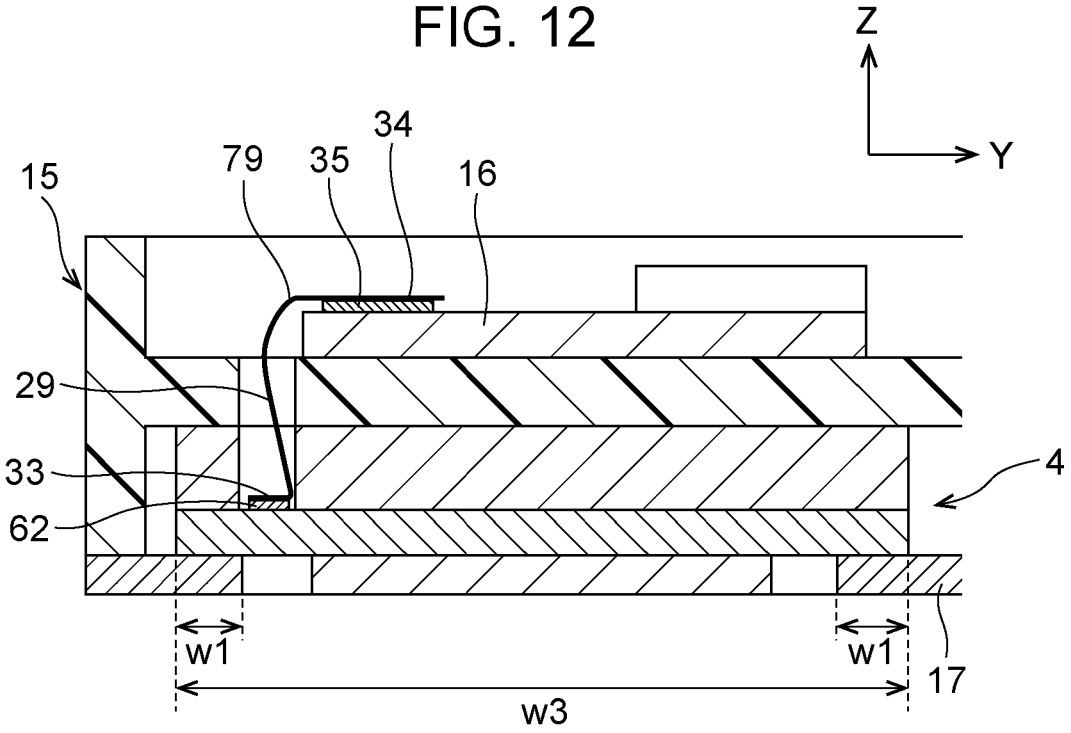
FIG. 12 is a view illustrating another example of the relationship between the fixation region of the flexible cable and the flow path-forming substrate and the fixation region of the flow path-forming substrate and the base plate.

FIG. 11 is a partial cross-sectional view of the recording head 3 cut in the Y direction, illustrating a relationship between the fixation region (i.e., installation portion) of the flexible cable 29 and the flow path-forming substrate 45 and the fixation region of the flow path-forming substrate 45 and the base plate 17. In addition, FIG. 12 is a partial cross-sectional view of the recording unit 3 cut in the Y direction, illustrating another example of the relationship between the fixation region (i.e., installation portion) of the flexible cable 29 and the flow path-forming substrate 45 and the fixation region of the flow path-forming substrate 45 and the base plate 17. In the embodiment, as illustrated in FIG. 11, the fixation region (i.e., installation portion) of the flexible cable 29 and the flow path-forming substrate 45, in other words, the connection region between the first terminal section 33 and the head substrate terminal section 62, overlaps the fixation region of the flow path-forming substrate 45 and the base plate 17 when viewed in plan view. In other words, when the width of the fixation region of the flow path-forming substrate 45 and the base plate 17 in the Y direction is a width w1, the fixation region of the flexible cable 29 and the flow path-forming substrate 45 is located within the range of the width w1. In contrast, in the example in FIG. 12, the fixation region of the flexible cable 29 and the flow path-forming substrate 45 does not overlap the fixation region of the flow path-forming substrate 45 and the base plate 17, and the fixation region of the flexible cable 29 and the flow path-forming substrate 45 is located out of the range of the width w1 and shifted toward the center of the flow path-forming substrate 45 in the Y direction. In this case, if the width w1 required for the fixation region of the flow path-forming substrate 45 and the base plate 17 is constant, a length w3, which is the length of the flow path-forming substrate 45 in the Y direction, inevitably becomes larger in the example illustrated in FIG. 12. On the other hand, if the length w3 is reduced, it is difficult to provide the width w1 required for the fixation region, which may lead to an insufficient bonding strength. However, with the configuration according to the embodiment, the length w2 of the flow path-forming substrate 45 in the Y direction can be reduced compared with the example in FIG. 12. Thus, the size of the flow path-forming substrate 45 can be reduced, which leads to a reduction in the size of the head unit 4. As a result, the head units 4 can be disposed densely. Moreover, the area of the fixation region can be increased, which results in reliable fixation of the head units 4 to the base plate 17.

Note that in the embodiment, the fixation region of the flexible cable 29 and the flow path-forming substrate 45 extends long in the X direction and short in the Y direction. Thus, the total area of the fixation region is relatively small. However, for example, in the case where this fixation region extends over the entire surface of the head substrate, the size of the flexible cable 29 increases, which poses a problem. Moreover, this leads to another problem that detachment of the flexible cable 29 from the substrate or the like tends to occur due to a difference in coefficient of thermal expansion between the flexible cable 29 and a substrate to which the flexible cable 29 is fixed. On the other hand, according to the embodiment, the fixation region of the flexible cable 29 and the flow path-forming substrate 45 has a small area, and the size of the flexible cable 29 can be reduced, which contribute to a reduction in the size of the head unit 4. Despite difference in coefficient of thermal expansion between the flexible cable 29 and the flow path-forming substrate 45, a negative impact due to such difference can be reduced.

In the embodiment, the coefficient of thermal expansion of the holder member 15, which is made of synthetic resin, is different from that of the base plate 17, which is made of metal. The difference in the coefficient of thermal expansion tends to cause the holder member 15 and the base plate 17 to warp. Even in this case, detachment of the installation portion of the flexible cable 29 can be suppressed. This improves flexibility in the selection of materials for the holder member 15 and the base plate 17 without being restricted by the difference in the coefficient of thermal expansion. The warping properties of the components, such as amount of warping or vulnerability to warping, can be predicted in advance based on the materials to be used. Thus, it is easier to address warping by, for example, changing the longitudinal direction of the installation portion of the flexible cable 29 on the components so as to orient in the X direction. As a result, detachment of the installation portion of the flexible cable 29 due to warping of the components that extend more in the Y direction can be suppressed, which improves the reliability of the printer 1.

Figure 13:
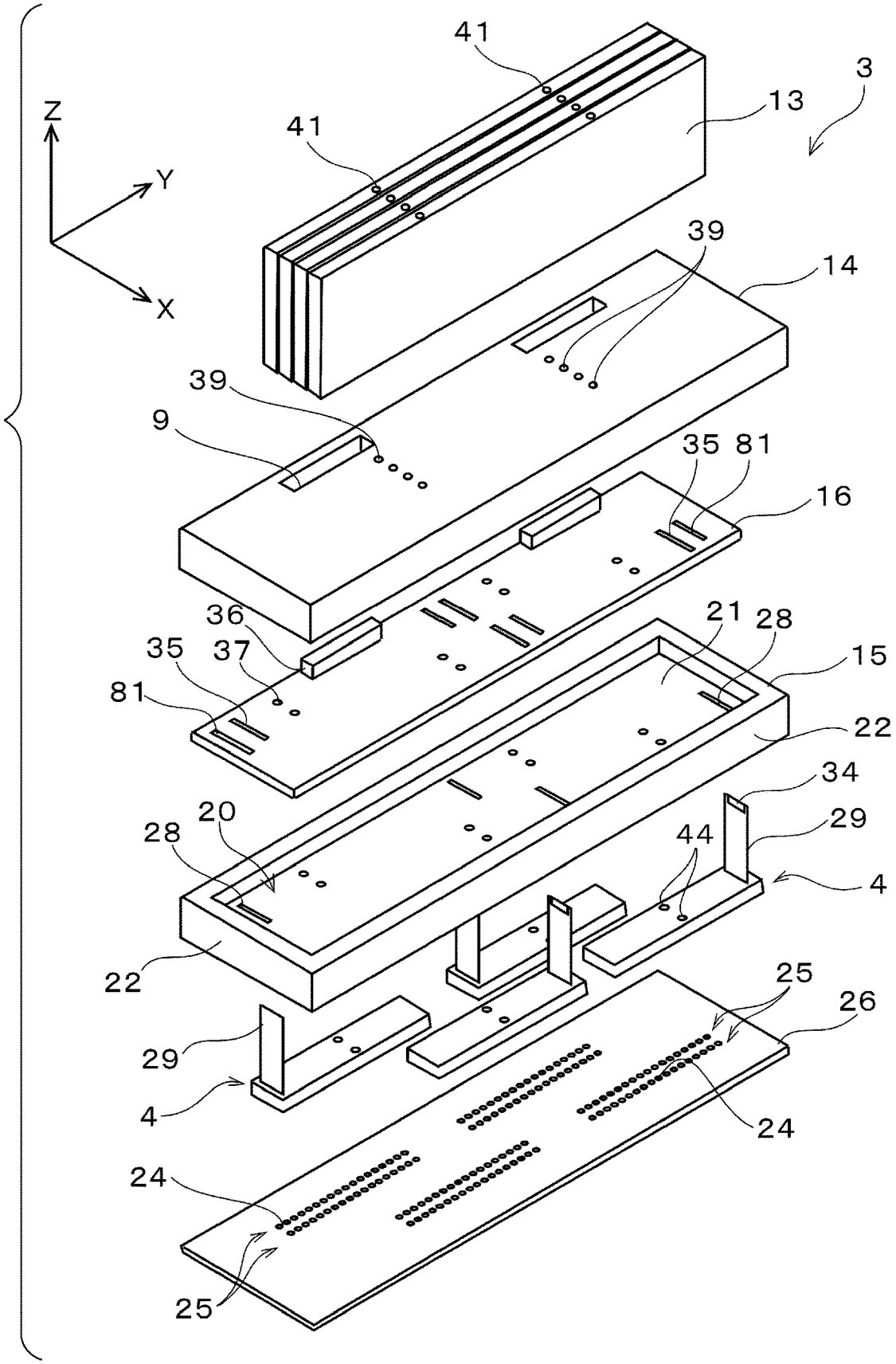
FIG. 13 is an exploded perspective view illustrating a liquid ejecting head according to a second embodiment.
Figure 14:
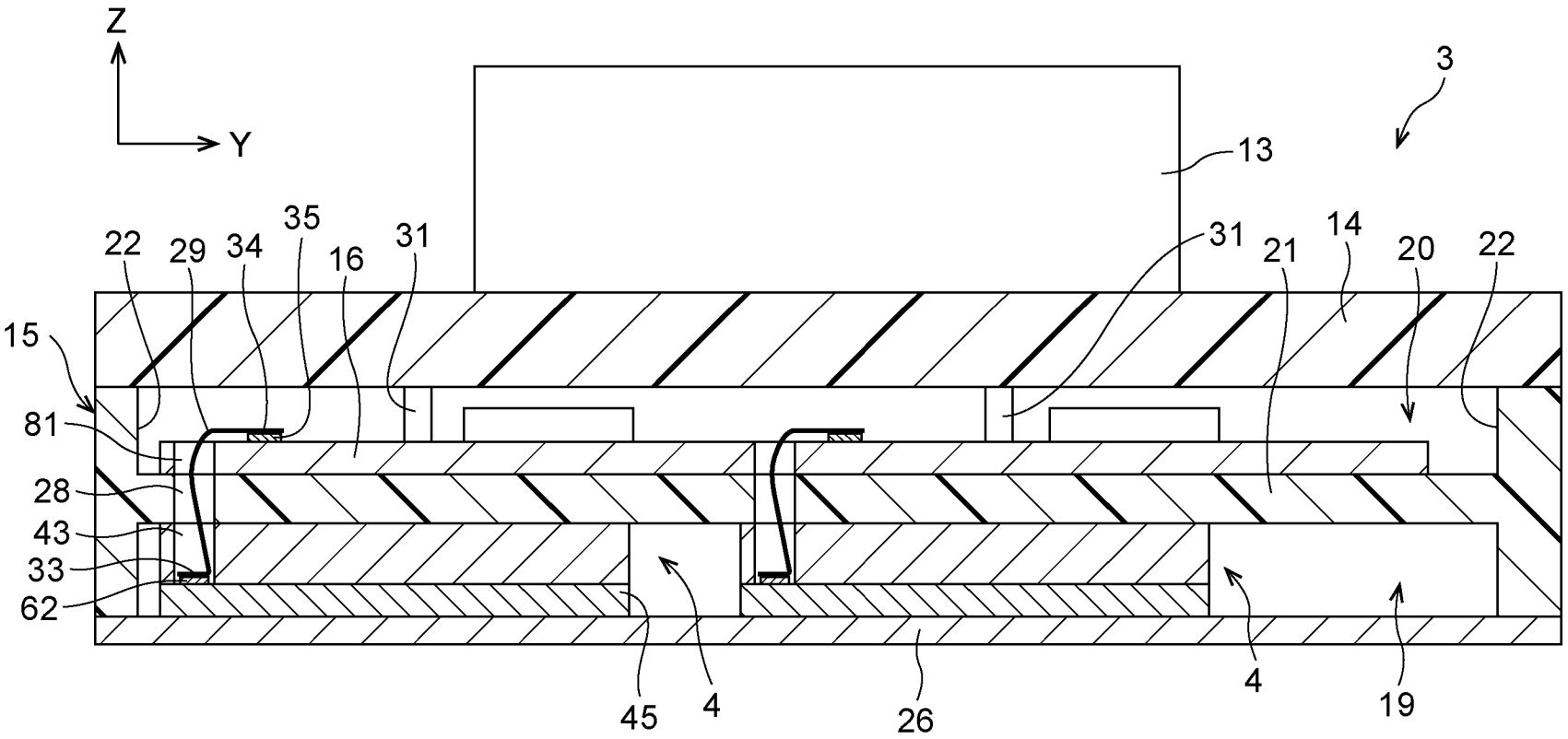
Figure 15:
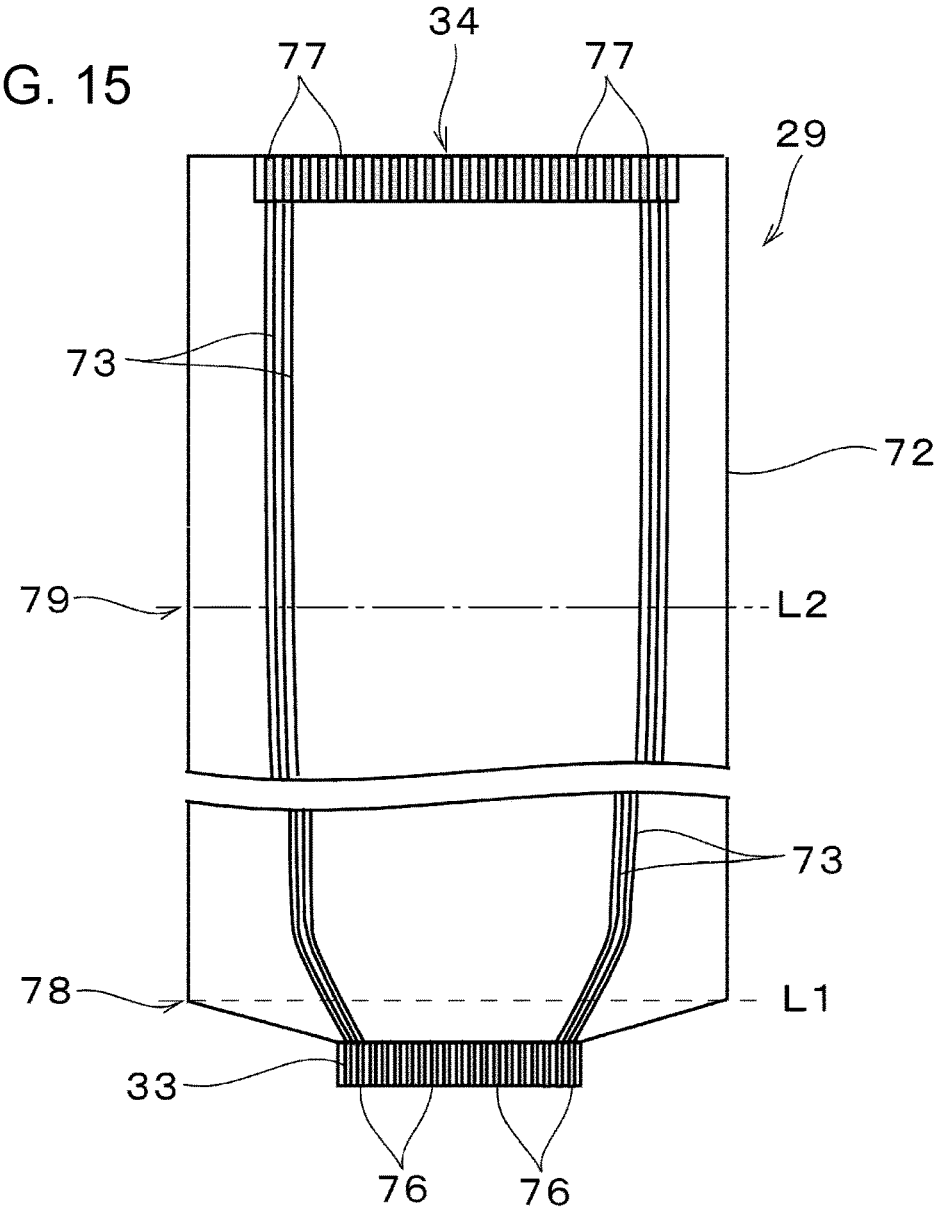
FIG. 15 is a view illustrating a structure of a flexible cable according to the second embodiment.

FIG. 13 is an exploded perspective view illustrating the recording head 3 according to a second embodiment. FIG. 14 is a cross-sectional view illustrating the recording head 3 according to the second embodiment, which is cut in the Y direction. FIG. 15 is a front view illustrating the flexible cable 29 according to the second embodiment. Components similar to those of the first embodiment are denoted by the same reference numerals, and duplicated description is thereby omitted. In the second embodiment, the base plate 17 according to the first embodiment is not provided. In the second embodiment, the nozzle plate 26, which has been provided for each of the head units 4 in the first embodiment, serves as a common member common to a plurality of the head units 4. In other words, the nozzle plate 26 according to the second embodiment is formed of a piece of a plate material that extends more in the Y direction than in the X direction when viewed in plan view. A plurality of the nozzles 24 and the nozzle rows 25 in which the nozzles 24 are arranged side by side are formed at regions corresponding to respective head units 4. In addition, in contrast to the first embodiment in which a plurality of the circuit substrates 16 are provided, a single circuit substrate 16 that commonly serves all the head units accommodated by the holder member 15 is provided in the second embodiment. In this circuit substrate 16, wiring through-holes 81 are formed at positions corresponding to the flexible cable through-holes 28 of the holder member 15. When connecting a flexible cable 29 to the circuit substrate 16, the flexible cable 29 is inserted into a flexible cable through-hole 28 that is provided in the partition wall 21 of the holder member 15 and also into a wiring through-hole 81. The flexible cable 29 is consequently taken out to the top side of the circuit substrate 16.

As illustrated in FIG. 15, the second terminal section 34 according to the embodiment is formed at the second end of the flexible cable 29 so as to extend in the width direction of the flexible cable 29 (i.e., in the X direction), In other words, the second terminals 77 of the second terminal section 34 are arranged side by side in the width direction of the flexible cable 29. Accordingly, the conductors 73 at the second end of the flexible cable 29 are also arranged side by side in the width direction of the flexible cable 29. Correspondingly, the circuit substrate terminal section 35 of the circuit substrate 16 are also formed in the X direction. A connection portion that electrically connects between the second terminal section 34 and the circuit substrate terminal section 35, in other words, the fixation region (i.e., the installation portion) where the flexible cable 29 and the circuit substrate 16 are fixed to each other, extends long in the X direction when viewed in plan view. This means that the second curved portion 79 also extends more in the X direction than in the Y direction. Accordingly, if warping occurs to some of the components of the recording head 3 that extend more in the Y direction than in the X direction when viewed in plan view, detachment of the second terminal section 34 from the circuit substrate terminal section 35 at the installation portion, which is constituted by electrical contacts, can also be suppressed in the present embodiment. Note that other configurations are the same as those of the first embodiment.

Figure 16:
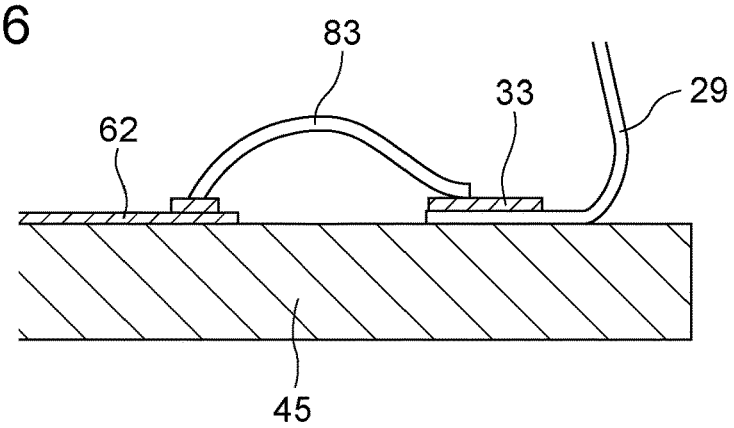
FIG. 16 is a view schematically illustrating a modification example related to an electrical connection between a terminal section of the flexible cable and a head substrate terminal section of the flow path-forming substrate.

FIG. 16 is a view schematically illustrating a modification example related to an electrical connection between the first terminal section 33 of the flexible cable 29 and the head substrate terminal section 62 of the flow path-forming substrate 45. In the foregoing embodiments, it has been described, by way of example, that the terminal sections 33 and 34 of the flexible cable 29 are electrically connected respectively to the head substrate terminal section 62 and the circuit substrate terminal section 35. The terminal sections 33 and the head substrate terminal section 62 are connected to each other in the fixation region between the flexible cable 29 and the flow path-forming substrate 45, and terminal sections 34 and the circuit substrate terminal section 35 are connected to each other in the fixation region between the flexible cable 29 and the circuit substrate 16. However, electrical connection is not limited to this configuration. For example, in a modification example illustrated in FIG. 16, the head substrate terminal section 62 is disposed at a position away from the fixation region between the flexible cable 29 and the flow path-forming substrate 45. While the flexible cable 29 and the flow path-forming substrate 45 are adhered to each other by using an adhesive, the first terminal section 33 of the flexible cable 29 and the head substrate terminal section 62 are electrically connected to each other by wires 83 by using wire bonding. Similarly, the second terminal section 34 of the flexible cable 29 and the circuit substrate terminal section 35 of the circuit substrate 16 may be electrically connected to each other also by using wire bonding.

If wire bonding is adopted as a method of electrical connection, the head substrate to which the flexible cable 29 is fixed is not limited to a component on which electric terminals or wires are formed. For example, the flexible cable 29 may be fixed to the protection substrate 46, and, by using wire bonding, the first terminal section 33 may be electrically connected to the head substrate terminal section 62 disposed on the flow path-forming substrate 45. In this example, the protection substrate 46 serves as the head substrate according to the invention.

Figure 17:
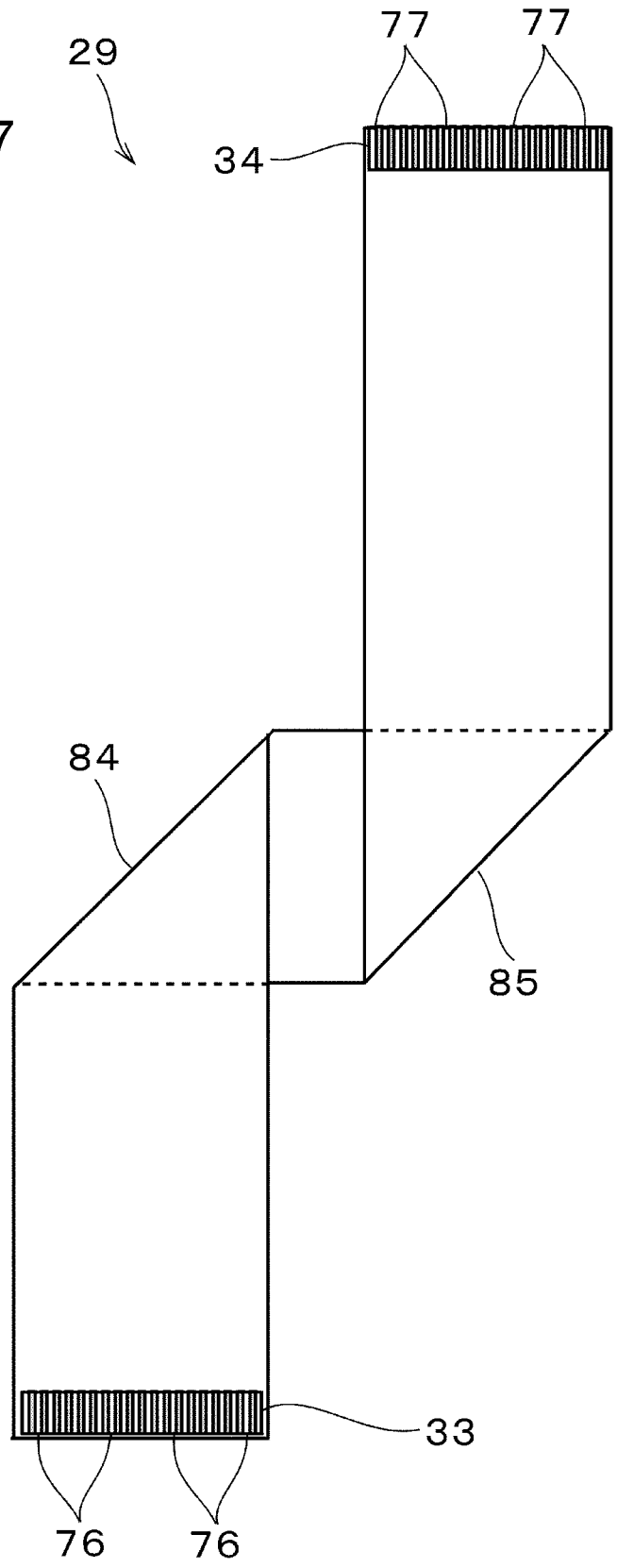
FIG. 17 is a view illustrating a structure of a modification example of the flexible cable.

FIG. 17 is a front view illustrating another modification example of the flexible cable 29. In the first embodiment, the flexible cable 29 has been described, by way of example, as being loose between the flow path-forming substrate 45 and the circuit substrate 16, but the flexible cable 29 is not limited to this configuration. For example, the flexible cable 29 may be folded between the flow path-forming substrate 45 and the circuit substrate 16. For example, the flexible cable 29 of the modification example illustrated in FIG. 17 is folded and thereby turns approximately 90 degrees both at a first folding portion 84 and at a second folding portion 85 that is different from the first folding portion 84. A manner of folding the flexible cable 29 may be arbitrarily selected depending on a layout of a substrate, such as a position of a terminal section on a substrate to which the flexible cable 29 is installed. The flexible cable 29 is folded as such between the flow path-forming substrate 45 and the circuit substrate 16, which adds an extra amount to the length of the flexible cable 29 as is the case in the first embodiment. Accordingly, even if the components that extend more in the Y direction than in the X direction warp, the extra amount in the length can relieve an impact of warping. As a result, detachment of the flexible cable 29 at the installation portion can be suppressed reliably.

In the above embodiments, a so-called line-type recording head, which ejects ink without scanning in the width direction with respect to a recording medium S, has been exemplified as the recording head 3. However, the invention can also be applied to a so-called serial-type recording head that ejects ink while moving reciprocally in the width direction of a recording medium S.

The invention has been described by taking the ink jet type recording head 3 as an example of liquid ejecting head. However, the invention may be applied to other types of liquid ejecting heads having a configuration in which a plurality of head units are fixed to a common member. For example, the invention may be applied to liquid ejecting heads, such as a color material ejecting head used in manufacturing color filters for liquid crystal displays, etc., an electrode material ejecting head used for forming electrodes for organic electroluminescence (EL) displays, field emission displays (FED), etc., and a living organic material ejecting head used in manufacturing biochips.

The entire disclosure of Japanese Patent Application Nos: 2017-117477, filed Jun. 15, 2017 and 2018-22826, filed Feb. 13, 2018 are expressly incorporated by reference herein.

What is claimed is:

1. A liquid ejecting head comprising:

head units each of which includes a corresponding head substrate and ejects liquid;

flexible cables each of which has one end connected to the corresponding head substrate; and a common member including the head units that are fixed thereto, wherein when a first direction, a second direction, and a third direction are directions that orthogonally intersect each other and the common member is placed on a virtual surface defined by the first direction and the second direction and has a thickness extending in the third direction, the common member extends more in the first direction than in the second direction, and the head units also each extend more in the first direction than in the second direction, and a fixation region in which each of the flexible cables and the corresponding head substrate are fixed to each other and, when viewed in the third direction, extends more in parallel to the second direction.

2. The liquid ejecting head according to claim 1, further comprising:

a circuit substrate to which another end of each of the flexible cables is fixed, wherein a region in which each of the flexible cables and the circuit substrate are fixed to each other extends more in the second direction than in the first direction when viewed in the third direction.

3. The liquid ejecting head according to claim 1, further comprising:

a circuit substrate to which another end of each of the flexible cables is fixed, wherein each of the flexible cables includes a first portion extending along the circuit substrate, a second portion extending in a direction intersecting the circuit substrate, and a curved portion located between the first portion and the second portion, and the curved portion extends more in the second direction than in the first direction.

4. The liquid ejecting head according to claim 2, further comprising:

a plurality of the circuit substrates; and a cover member that extends more in the first direction than in the second direction and covers the plurality of the circuit substrates in collaboration with the common member.

5. The liquid ejecting head according to claim 2, wherein each of the flexible cables is loose between the corresponding head substrate and the circuit substrate.

6. The liquid ejecting head according to claim 2, wherein each of the flexible cables is folded between the corresponding head substrate and the circuit substrate.

7. The liquid ejecting head according to claim 2, further comprising:

a holder member that extends more in the first direction than in the second direction when viewed in the third direction, wherein the holder member has a first recess that is formed on a first side of the holder member and in which the head units are accommodated and a second recess that is formed on a second side of the holder member, the second side being opposite to the first side, and in which the circuit substrate is accommodated.

8. The liquid ejecting head according to claim 7, wherein a coefficient of thermal expansion of the holder member is different from a coefficient of thermal expansion of the common member.

9. The liquid ejecting head according to claim 1, wherein each of the head units extends more in the first direction than in the second direction, and the head units are arranged in the first direction.

10. The liquid ejecting head according to claim 1, wherein, when viewed in the third direction, a region in which each of the flexible cables and the corresponding head substrate are fixed to each other overlaps a region in which a corresponding one of the head units and the common member are fixed to each other.

11. The liquid ejecting head according to claim 1, wherein a position at which each of the flexible cables starts to extend away from the corresponding head substrate is located away from a center of a corresponding one of the head units in the first direction, and each of the flexible cables fixed to the corresponding head substrate of each of the head units that are located closer to respective ends of the common member in the first direction than the rest of the head units is disposed away from a center of the common member in the first direction.

12. The liquid ejecting head according to claim 1, wherein each of the flexible cables includes conductors and a thickness of each of the conductors at the one end is less than a thickness of each of the conductors at another end of each of the flexible cables.

13. The liquid ejecting head according to claim 1, wherein each of the flexible cables includes conductors and a pitch between the conductors at the one end is narrower than a pitch between the conductors at another end of each of the flexible cables.

14. The liquid ejecting head according to claim 1, wherein each of the flexible cables includes conductors and the conductors are arranged, at the one end, in a width direction of each of the flexible cables, and the conductors are arranged, at another end, in a longitudinal direction of each of the flexible cables.

15. A liquid ejecting apparatus comprising the liquid ejecting head according to claim 1.

16. A liquid ejecting apparatus comprising the liquid ejecting head according to claim 2.

* * * * *